US007568763B2

(12) United States Patent
Bedford et al.

(10) Patent No.: US 7,568,763 B2
(45) **Date of Patent: *Aug. 4, 2009**

(54) CONTROL FOR SEATING UNIT WITH BACK STOP

(75) Inventors: Adam C. Bedford, Rockford, MI (US); David A. Bodnar, Ada, MI (US); Gary Lee Karsten, Wayland, MI (US); Robert J. Battey, Middleville, MI (US); Kurt R. Heidmann, Grand Rapids, MI (US); Gordon J. Peterson, Rockford, MI (US)

(73) Assignee: Steelcase Inc., Grand Rapids, MI (US)

( * ) Notice: Subject to any disclaimer, the term of this patent is extended or adjusted under 35 U.S.C. 154(b) by 509 days.

This patent is subject to a terminal disclaimer.

(21) Appl. No.: 11/293,553

(22) Filed: Dec. 2, 2005

(65) Prior Publication Data

US 2006/0071522 A1 Apr. 6, 2006

Related U.S. Application Data

(63) Continuation-in-part of application No. 10/845,978, filed on May 14, 2004, now Pat. No. 7,048,335, and a continuation-in-part of application No. 10/846,304, filed on May 14, 2004, now Pat. No. 7,097,247, which is a continuation-in-part of application No. 10/792,309, filed on Mar. 3, 2004, now Pat. No. 6,932,430, which is a continuation-in-part of application No. 10/455,076, filed on Jun. 5, 2003, now Pat. No. 6,880,886.

(51) Int. Cl.

| | |
|---|---|
| *A47C 3/026* | (2006.01) |
| *A47C 1/024* | (2006.01) |
| *A47C 1/038* | (2006.01) |

(52) U.S. Cl. ..... 297/300.1; 297/285; 297/286; 297/300.2; 297/300.5; 297/300.6; 297/300.7; 297/300.8; 297/301.3; 297/301.5; 297/301.6; 297/301.7

(58) Field of Classification Search ..... 297/285, 297/286, 300.6, 300.7, 300.8, 301.5, 301.6, 297/301.7, 300.1, 300.2, 300.5, 342, 301.3
See application file for complete search history.

(56) References Cited

U.S. PATENT DOCUMENTS

| | | | |
|---|---|---|---|
| 2,087,254 | A | 7/1937 | Herold |
| 2,156,664 | A | 5/1939 | Litle, Jr. |

(Continued)

FOREIGN PATENT DOCUMENTS

| | | |
|---|---|---|
| WO | WO 82/01760 | 5/1982 |

*Primary Examiner*—Rodney B White
(74) *Attorney, Agent, or Firm*—Price, Heneveld, Cooper, DeWitt & Litton, LLP

(57) ABSTRACT

A seating unit includes a base with a control housing, a back supported on the base for reclining movement, and a seat supported at least partially by a pivoting link on the base for synchronous movement with the back upon recline of the back. A back stop is operably mounted on a pair of parallel guide rods that extend transversely across the control housing for selective movement to a plurality of different positions where the back stop engages the link to limit movement of the seat and hence limit recline of the back to a plurality of selectable recline positions corresponding to the plurality of different positions.

26 Claims, 26 Drawing Sheets

U.S. PATENT DOCUMENTS 2,316,628 A 4/1943 Schaffner
2,711,211 A 6/1955 Tidcombe
3,035,828 A 5/1962 Stubnitz
3,044,831 A 7/1962 Neely
3,165,308 A 1/1965 Rathbun
3,175,629 A 3/1965 Rowley
3,434,756 A 3/1969 Walkinshaw
4,125,288 A * 11/1978 Hunter ..... 297/301.3
4,318,556 A 3/1982 Rowland
4,361,357 A 11/1982 Pollock
4,709,962 A 12/1987 Steinmann
4,768,244 A 9/1988 Riedl
4,935,977 A 6/1990 Yamada
4,966,411 A 10/1990 Katagiri et al.
5,022,709 A 6/1991 Marchino
5,026,117 A * 6/1991 Faiks et al. ..... 297/300.5
5,160,184 A 11/1992 Faiks et al.
5,269,497 A 12/1993 Barth
5,282,285 A 2/1994 de Gelis et al.
5,316,371 A 5/1994 Bishai
5,385,389 A 1/1995 Bishai
5,658,049 A 8/1997 Adams et al.
5,762,399 A 6/1998 Liu
5,871,258 A * 2/1999 Battey et al. ..... 297/300.2 X
5,931,531 A 8/1999 Assman
5,979,984 A 11/1999 DeKraker et al.
6,000,756 A 12/1999 Hybarger et al.
6,033,020 A 3/2000 Ito
6,086,153 A * 7/2000 Heidmann et al. ..... 297/300.1
6,116,695 A 9/2000 Heidmann et al.
6,378,943 B1 4/2002 Beggs et al.
6,550,866 B1 4/2003 Su
6,585,320 B2 7/2003 Holbrook et al.
6,598,936 B1 * 7/2003 Klein ..... 297/301.3 X
6,685,267 B1 * 2/2004 Johnson et al. ..... 297/300.1
6,779,847 B2 * 8/2004 Klein ..... 297/301.3 X
6,869,142 B2 3/2005 Heidmann et al.
6,880,886 B2 * 4/2005 Bodnar et al. ..... 297/285
6,932,430 B2 8/2005 Bedford et al.
7,048,335 B2 * 5/2006 Norman et al. ..... 297/300.2
7,097,247 B2 * 8/2006 Battey et al. ..... 297/284.4
7,097,249 B2 * 8/2006 Igarashi et al. ..... 297/301.3 X
7,243,993 B2 * 7/2007 Igarashi et al. ..... 297/301.3 X
2002/0043867 A1 4/2002 Lessmann
2004/0004380 A1 * 1/2004 Horiki et al. ..... 297/300.5
2005/0029848 A1 * 2/2005 Heidmann et al. ..... 297/300.1

* cited by examiner

CONTROL FOR SEATING UNIT WITH BACK STOP

CROSS REFERENCE TO RELATED APPLICATIONS

This application is a continuation-in-part of co-assigned, co-invented application Ser. No. 10/845,978, filed May 14, 2004, now U.S. Pat. No. 7,048,335 entitled SEATING UNIT WITH CROSS BAR SEAT SUPPORT, and also a continuation-in-part of co-assigned, co-invented application Ser. No. 10/846,304, filed May 14, 2004, now U.S. Pat. No. 7,097,247 entitled SEATING UNIT WITH ADJUSTABLE LUMBAR DEVICE, both of which are continuation-in-part of co-assigned co-invented application Ser. No. 10/792,309, filed Mar. 3, 2004,entitled COMBINED TENSION AND BACK STOP FUNCTION FOR SEATING UNIT (now U.S. Pat. No. 6,932,430), which is a continuation-in-part of Ser. No. 10/455,076, filed Jun. 5, 2003, entitled COMBINED TENSION AND BACK STOP FUNCTION FOR SEATING UNIT (now U.S. Pat. No. 6,880,886), the entire contents of which are incorporated herein in their entirety. This application is also related to the following applications: Ser. No. 10/241,955, filed Sep. 12, 2002, entitled SEATING UNIT HAVING MOTION CONTROL (now U.S. Pat. No. 6,869, 142); Ser. No. 10/455,503, filed Jun. 5, 2003, entitled CONTROL MECHANISM FOR SEATING UNIT (now pending), the entire contents of each of which are also incorporated herein by reference in their entirety.

BACKGROUND

The present invention relates to seating units having a seat support and back coupled to a base for synchronous movement and having an underseat control for controlling movement of the back to recline positions.

Synchrotilt chairs provide a seat that moves simultaneously with recline of its back, such as to reduce "shirt pull" upon recline, to improve comfort, and to promote healthier support when performing tasks while seated for extended periods of time. In one type of synchrotilt chair, the seat moves forward upon recline of its back, so that a seated user's hands stay relatively stationary whether the back is in the upright or reclined position. This is not easily accomplished, since it requires a mechanism that creates stable and smooth forward movement of the seat during rearward recline of the back. Also, it is desirable to reduce cost, weight, and assembly time, and to accomplish this with simplified components. At the same time, the competitive furniture market requires high quality and durability. There are many conflicting and challenging design requirements, such as the desire for small package size, while maintaining an attractive appearance, an environmental "green" friendliness (including the ability to separate components into recyclable parts without substantial effort), and a desire for design flexibility, relatively few components, and mechanically-efficient arrangements that are durable, long-lasting, robust, and easily assembled.

It is known to limit rearward recline of a back through use of a pivoting cam. (See cam/back-stop mechanism 36 in FIG. 8 of Bedford U.S. Pat. No. 5,871,258.) However, it is desirable to provide alternative motions and parts to meet packaging requirements and functional requirements of the present chair design with novel biasing springs. Also, improvements are desired to increase design flexibility, simplify components, reduce parts and pieces, make them lower in weight and cost, improve assembly and reduce manual labor during assembly, and to make the assembly more durable and robust.

Thus, a system having the aforementioned advantages and solving the aforementioned problems is desired.

SUMMARY OF THE PRESENT INVENTION

In one aspect of the present invention, a seating unit includes a base with a control housing and a guide extending across the control housing. A seat is supported on the base and a back is supported on the base for reclining movement. A back stop is slidably mounted on the guide for selective translational movement to a plurality of different positions where the back stop limits recline of at least the back to a plurality of selectable recline positions corresponding to the plurality of different positions.

In another aspect of the present invention, a seating unit includes a base with a control housing, a back supported on the base for reclining movement, and a seat connected by a pivoting link to the base for synchronous movement with the back upon recline of the back. A back stop is operably mounted on the control housing for selective movement to a plurality of different positions where the back stop engages the link to limit movement of the seat and hence limit recline of the back to a plurality of selectable recline positions corresponding to the plurality of different positions.

In yet another aspect of the present invention, a seating unit includes a base with a control housing and at least one flexible support extending laterally on each side of the housing, the at least one flexible support including ends configured to flexibly move in forward and rearward directions. A back and a seat are supported on the base for synchronous movement upon recline of the back, at least one of the back and seat being supported by the ends of the at least one flexible support. A back stop is operably mounted on the control housing for selective movement to a plurality of different positions where the back stop limits movement of the seat and hence limits recline of the back to a plurality of selectable recline positions corresponding to the plurality of different positions.

In still another aspect of the present invention, an improvement is provided for a seating unit having a control housing and a back supported on the control housing for reclining movement along a first direction. The improvement includes at least one laterally-extending guide in the control housing and a back stop slidably mounted on the guide for translational movement between different back stopping positions.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
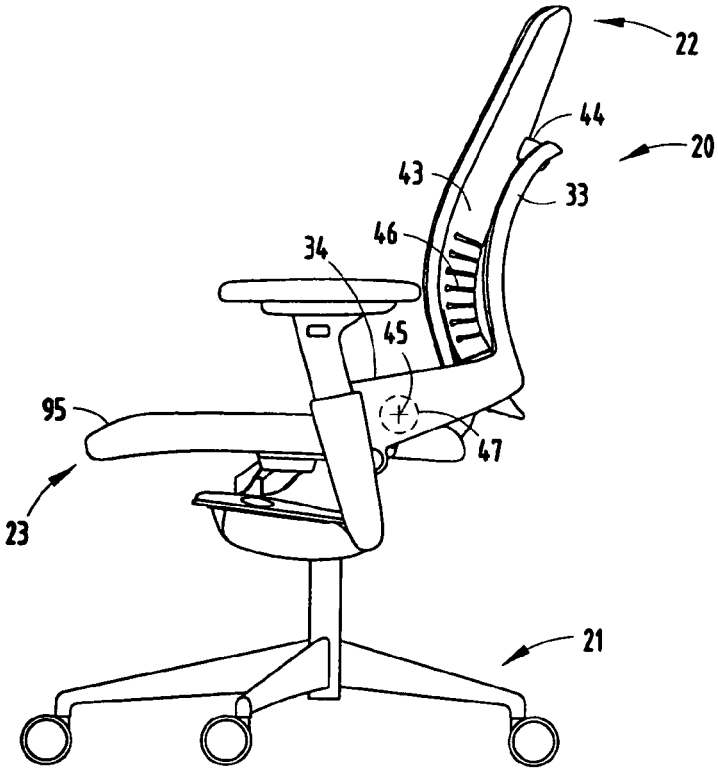
FIGS. 1-2 are side and front views of a seating unit embodying the present invention.

A seating unit 20 (FIG. 1) includes a base 21, a back 22 and seat 23 operably supported on the base 21 for synchronous movement between upright and reclined positions. The seat 23 is operably supported by a U-shaped seat-supporting structure 36 that provides a multi-point stable support arrangement for the seat 23 on the base 21, with the seat-supporting structure 36 being a relatively simple yet very effective structural component that offers reduced weight, reduced cost, compact size, and robust support for the seat 23.

Figure 7:
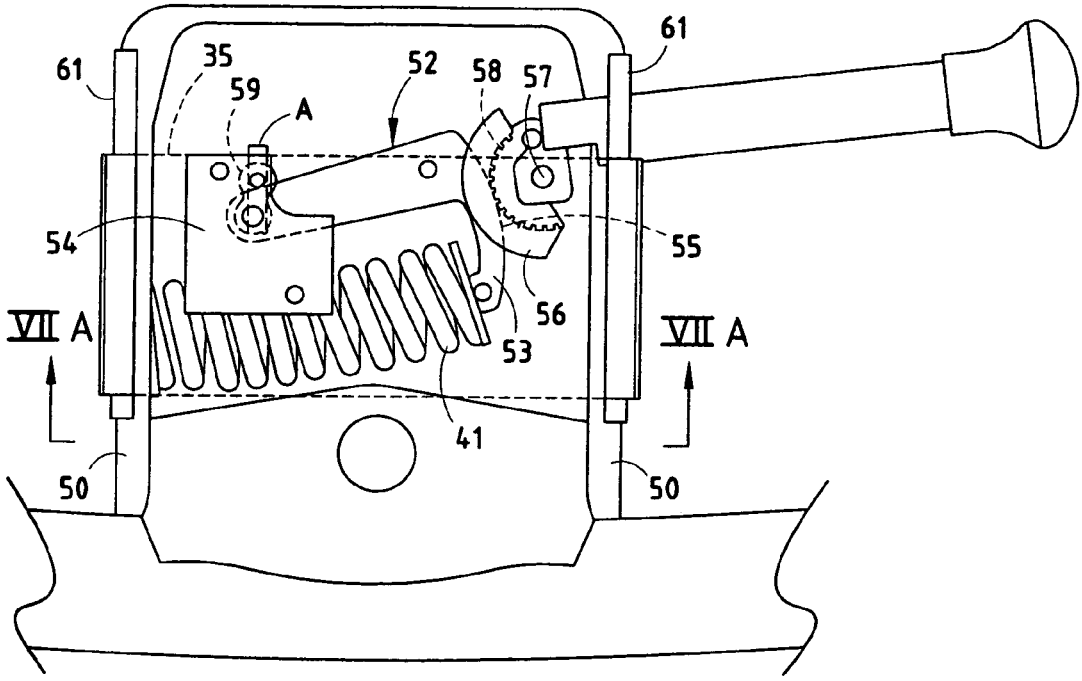
FIG. 7 is a top view of the control housing and energy mechanism of FIG. 3.
Figure 7A:
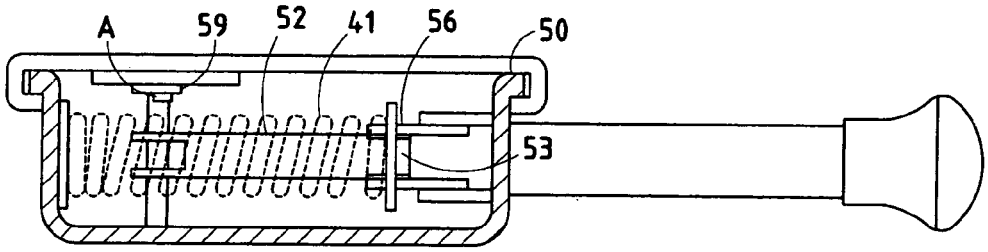
FIG. 7A is a cross-sectional view taken along the line VIIA-VIIA in FIG. 7.

The base 21 includes a spider-legged arrangement with castors, and a height-adjustable post. The base 21 (FIG. 3) includes a housing 31 fixed atop the post and support arms 32 extending laterally and upwardly on each side of the housing 31. The back 22 includes an arched U-shaped back frame 33 with lower end sections (i.e. arms 34) pivoted to the stationary support arms 32 on each side. A slide member 35 slidably engages the housing 31. A seat-supporting structure 36 includes a crossbar 37 pivotally attached to the slide member 35 at a first pivot location 38 and side frame sections 39 that extend rearwardly from ends of the crossbar 37. The ends of the side frame sections 39 are pivotally attached to the lower arms 34 of the back frame 33 at a second pivot location 40 spaced horizontally from the first pivot location 38. The sliding pivot location 38 and the second pivot location 40 define a multi-point stable support for a seat 23 above the housing 31. A spring 41 (FIG. 7) is operably coupled to the slide member 35 to bias the back frame 33 and seat-supporting structure 36 toward their respective upright positions.

The back 22 (FIG. 1) includes a back shell 43 supported on the back frame 33 at top and bottom pivot locations 44 and 45. The back shell 43 includes a lumbar region 46 that is flexible for comfortably supporting a seated user, and further includes a spring 47 biasing the back shell 43 toward a forwardly protruding shape. The present description is sufficient for an understanding of the present invention, but if additional detail is desired, it can be found in Battey U.S. Pat. No. 5,871,258 which discloses additional detail of a back arrangement similar to the back 22. The entire contents of Battey U.S. Pat. No. 5,871,258 are incorporated herein in their entirety by reference.

The housing 31 (FIG. 4) is supported on the base 21, and includes sidewalls 50 providing a recess into which a biasing device (i.e. coil spring 41) is positioned. An L-shaped torque arm 52 (FIG. 7) is also operably positioned in the recess and includes a first leg 53 engaging an end of the spring 41, and a second leg 54. A back surface of the first leg 53 defines a row of teeth 55. A half-disk-shaped support 56 is supported by a pivot pin 57, and includes an arcuate row of teeth 58 that mate with the teeth 55 to pivotally support the torque arm 52 with a non-slip configuration. The second leg 54 has an end attached to a link 59 that is in turn connected to the slide member 35. The slide member 35 includes bearings 61 that slidably engage the housing 31, such as by slidably engaging the top edges of the sidewalls 50. As will be understood below, when a seated user reclines the back 22, the slide member 35 is moved forward by arms 34, causing the L-shaped torque arm 52 (FIG. 7) to pivot on arcuate support 56, thus compressing the spring 41. This provides a resistance to recline of the back 22, since the seat 23 is connected to the back frame 33, as described above. Notably, the half-disk-shaped support 56 is rotatably adjustable to adjust a length of the torque arm defined by the first leg 53, thus providing an easily operated spring tension adjustment mechanism. The above discussion of the biasing device and system and system operation are sufficient for an understanding of the present invention, but it is noted that they are described in detail in Battey U.S. Pat. No. 5,871,258, which was incorporated by reference above.

Figure 4:
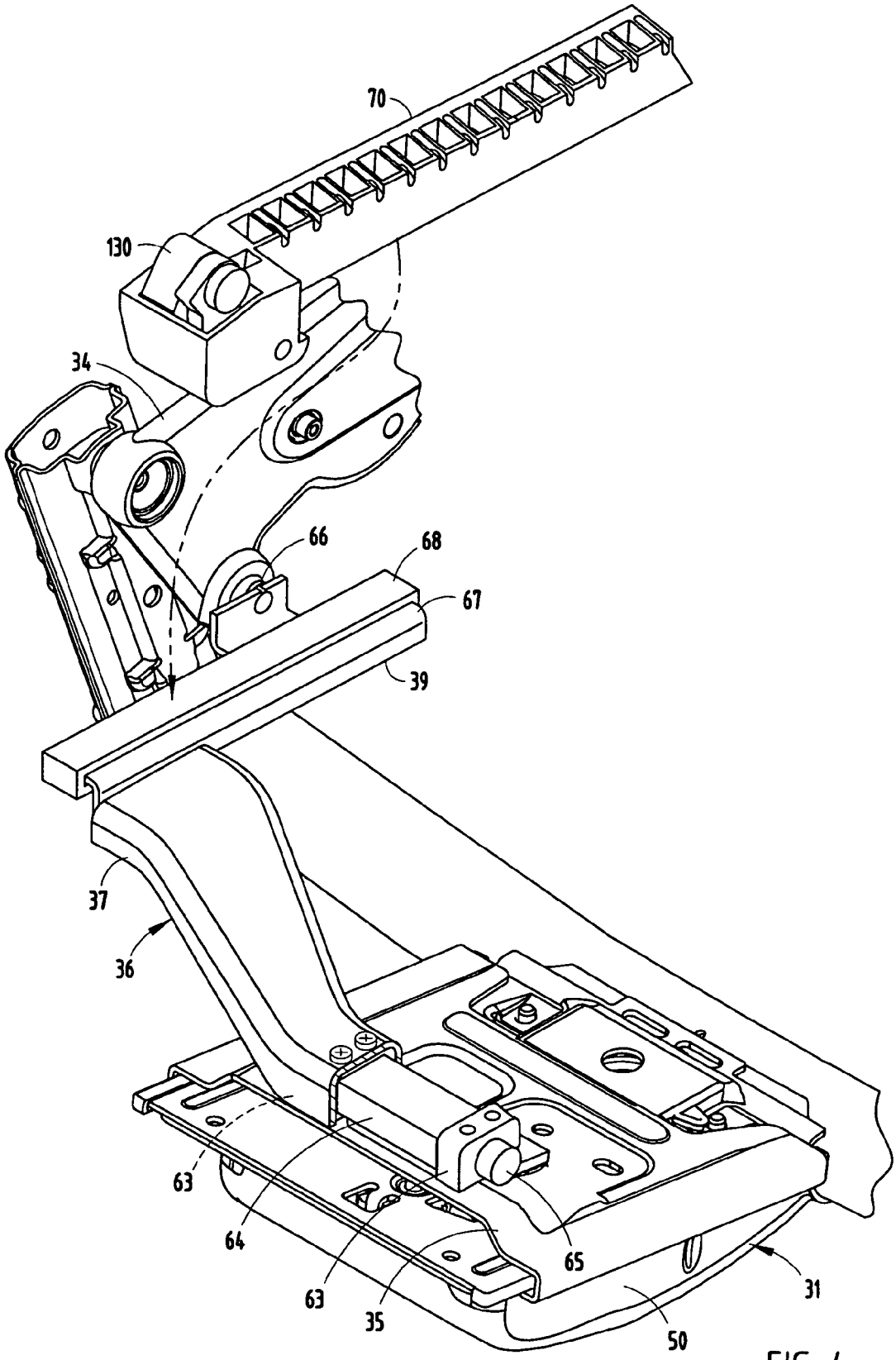
FIG. 4 is a fragmentary perspective view of the control housing and crossbar/seat-supporting structure.

The seat-supporting structure 36 (FIG. 4) includes the crossbar 37 and side frame sections 39 rigidly fixed to the crossbar 37 and extending rearwardly. The illustrated side frame sections 39 extend only rearwardly, but it is contemplated that the side frame sections 39 could extend forwardly (see the embodiment of FIG. 15, with crossbar 37A and side frame members 39A). Alternatively, it is contemplated that the side frame members could extend both forwardly and rearwardly, and/or could form part of a perimeter frame supporting a seat and that is supported by the crossbar above a base and control housing. The crossbar 37 has a lower center section with a pair of apertured down tabs 63. A mounting block 64 is attached to a top of the slide member 35, and fits between the down tabs 63 where it is pivotally secured to the down tabs 63 by a pivot pin 65 (FIG. 4). It is contemplated that a variety of other pivot arrangements can also be constructed that will work in the present invention.

The side frame sections 39 (FIG. 4) have protrusions 66 that extend outwardly from tail ends of the frame section 39 into pivotal engagement with mating structures on the support arms 34 of the back 22. The protrusions 66 are located horizontally rearwardly of the mounting block 64 and pivot pin 65, to thus provide a non-aligned multi-point support system for the seat-supporting structure 36. The mounting system provides a three point support where the mounting block 64 is relatively narrow, but it is noted that where the mounting block 64 is elongated, it might be considered a four point support arrangement. The points of support preferably should be horizontally spaced apart sufficiently to provide a stable seat support structure. It is contemplated that a horizontal spacing in a fore-aft direction of about 6 inches will provide sufficient stability. However, this dimension will change depending upon the structural stiffness and rigidity of the base 21, especially housing 31, cross bar 37, the seat 23, and other structural components of the chair 20.

Figure 3:
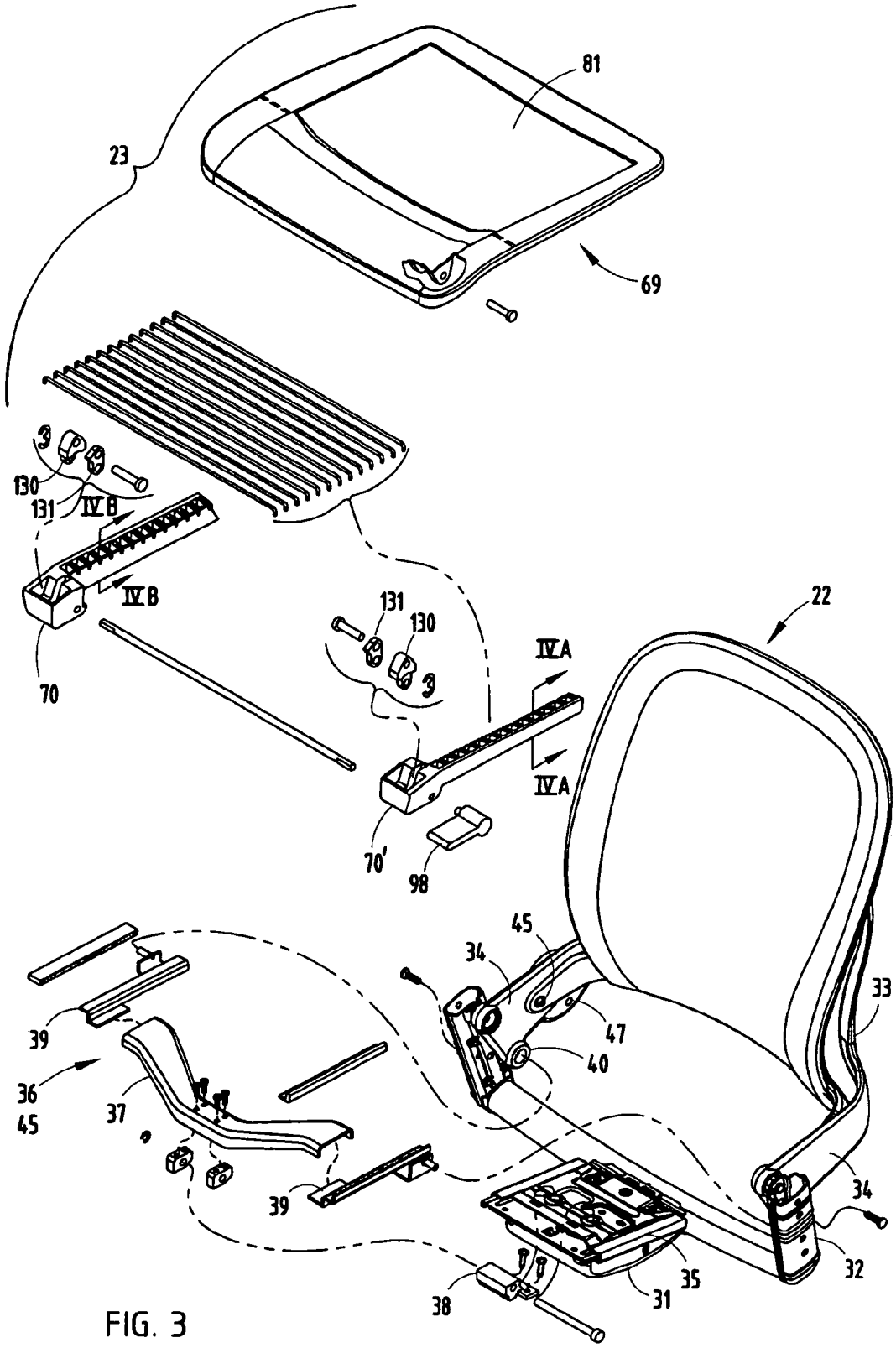
FIG. 3 is an exploded perspective fragmentary view of the seating unit of FIG. 1.
Figure 4A:
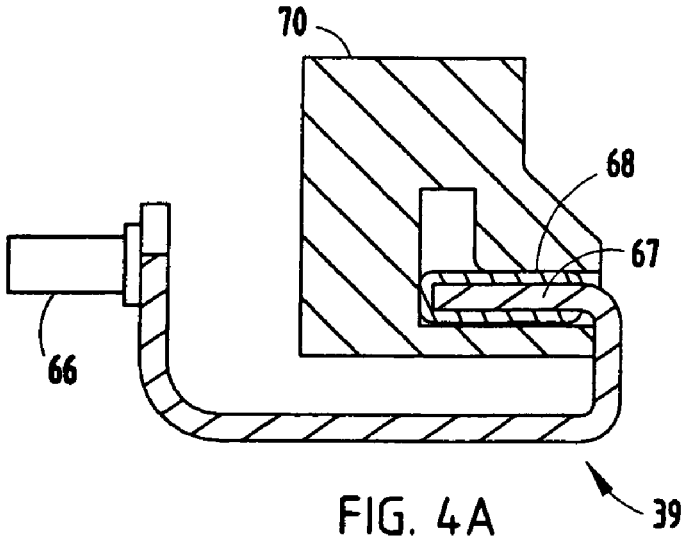
FIGS. 4A and 4B are cross-sectional views taken at the RH and LH rear pivots of the seat-supporting structure.
Figure 4B:
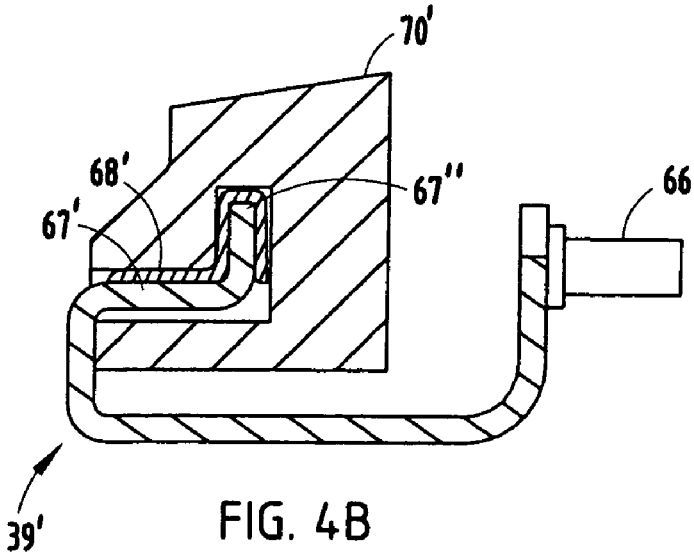
Figure 5:
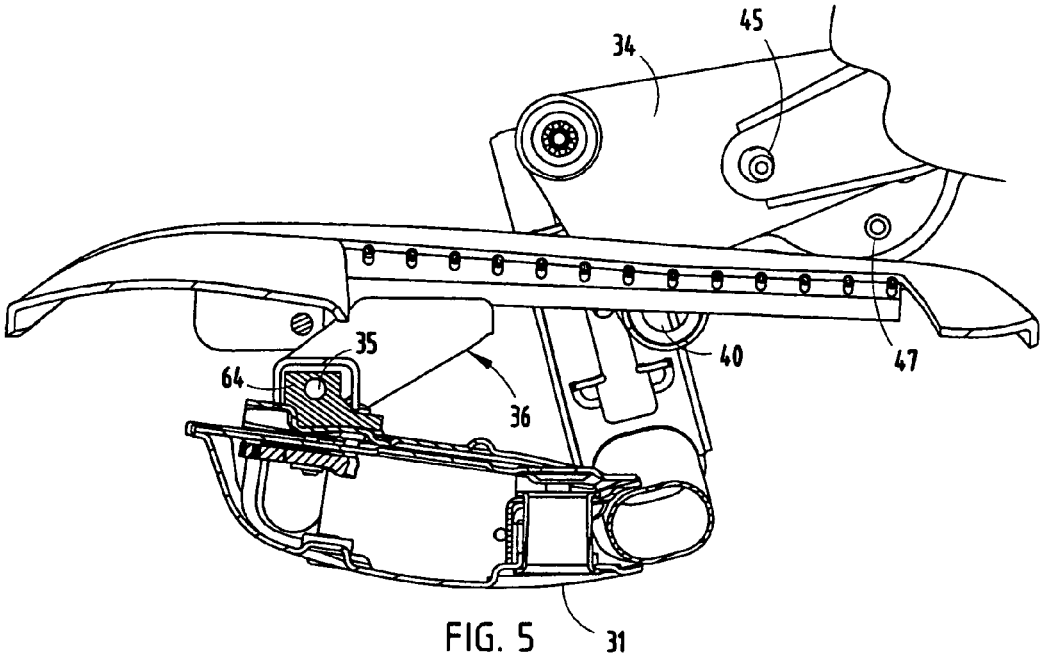
FIGS. 5-6 are cross-sectional views taken along the line V-V in FIG. 2 and the line VI-VI in FIG. 1, respectively.
Figure 6:
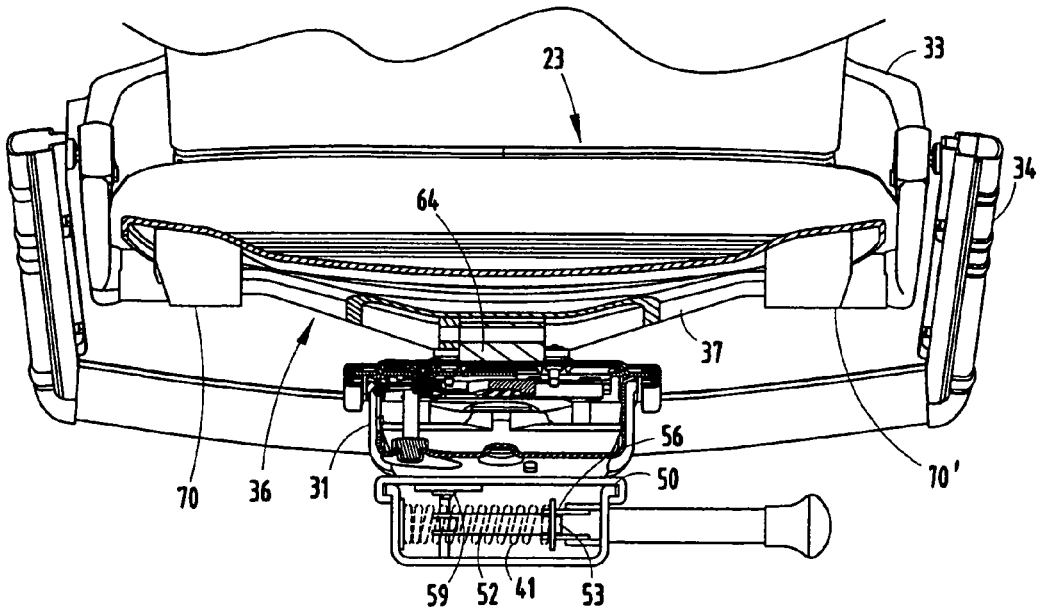

One of the side frame sections 39 (FIG. 4A) comprises a beam defining a flat horizontal bearing flange 67 and bearing cap 68, and the other of the side frame sections 39' (FIG. 4B) comprises a beam defining an L-shaped horizontal bearing flange 67' and bearing cap 68'. The seat 23 includes a perimeter frame 69 with side frame members 70 and 70' (FIG. 3) attached to each respective side. The side frame member 70 is shaped to mateably and slidably engage the bearing flange 67 and bearing cap 68 (FIG. 4A) and the side frame member 70' is shaped to mateably and slidably engage the bearing flange 67' and bearing cap 68' (FIG. 4B). Notably, the bearings 67, 67', 68, and 68' slidably support the seat 23 for fore-aft movement during seat depth adjustment, while the up flange 67" on bearing flange 67' serves to guide the seat 23 as it moves in a fore-aft direction without binding. Notably, the up flange 67" forms a guide that is very resistant to the seat becoming skewed and bound up. This is due to the length to width ratio of the bearing 67'. It is contemplated that the present invention can be used with or without having a seat depth adjustment feature on the chair.

It is contemplated that the present inventive crossbar arrangement can be used with a wide variety of different seats. Nonetheless, the present illustrated seat is particularly comfortable, environmentally "green" friendly, and desirable for many reasons. Notably, a seat not unlike the illustrated seat is described in detail in pending application Ser. No. 10/792,309 which was incorporated by reference above.

Figure 10:
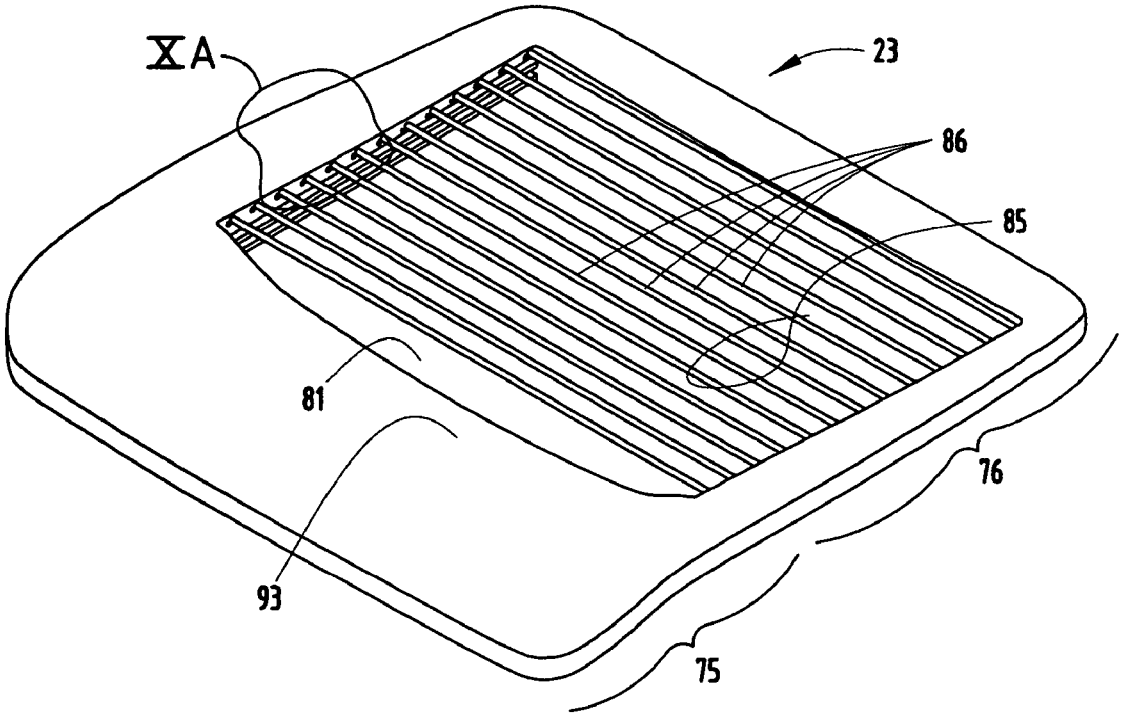
FIG. 10 is a perspective view of the seat of FIG. 3.

The illustrated seat 23 (FIG. 10) includes a front portion 75 and a rear portion 76 extending forward from the rear portion 75. It is noted that the front and rear portions 75 and 76 are particularly constructed to provide comfortable seating, while also being constructed to meet the difficult functional requirements of a seat. The difficult functional requirements for seats come from both use and abuse conditions. In "normal" use, a seated user will position themselves fully onto the seat, with their pelvis at a rear of the seat. However, seated users also often slouch (i.e. the seated user is leaning against the back 22, but their pelvis is near a front edge of the seat 23) or perch (i.e. the seated user is sitting upright, but his/her pelvis and full weight is near a front edge of the seat 23). Also, users sometimes abuse chairs by trying to stand on the seat. While this is strongly recommended against, it still is a condition that a chair may be subjected to and for which there are seating standards proposed by the Business and Furniture Industry Manufacturers Association (BIFMA), a trade association. When a person stands on a seat, substantial pressure is applied at whatever location they stand on, which may be in the front portion 75 or rear portion 76.

Figure 10A:
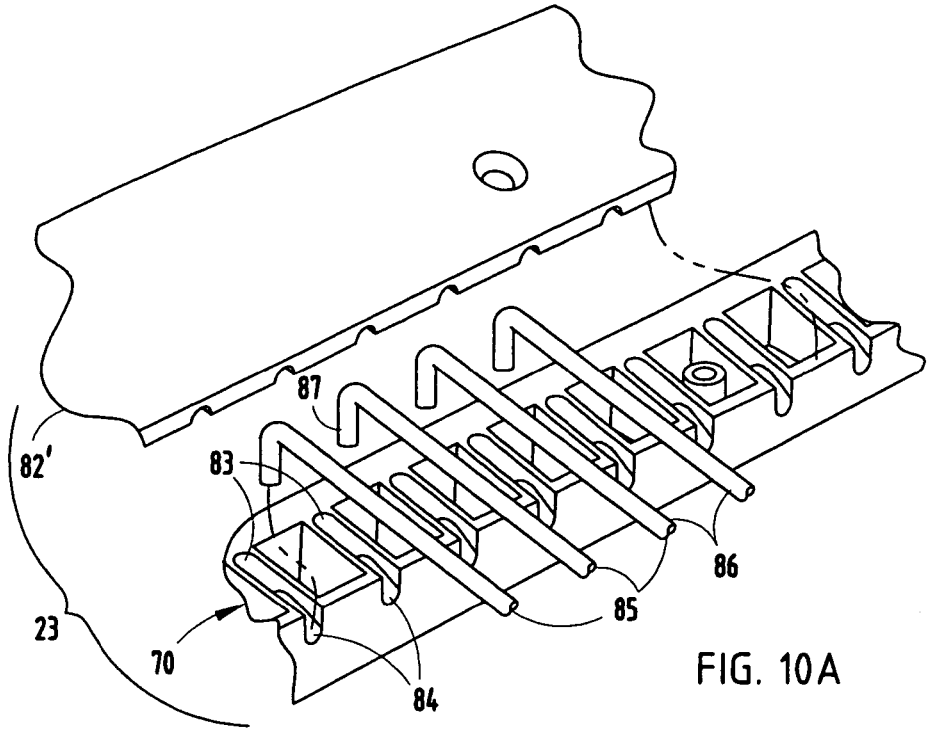
FIG. 10A is a fragmentary exploded perspective view of the seat in FIG. 10, and FIGS. 10B-10C are cross sections showing operative positions of the flexible members of FIG. 10.

The illustrated rear portion 76 (FIG. 3) includes the perimeter frame 69 and defines an opening 81. The perimeter frame 69 (FIG. 10A) is attached to the frame members 70 and a top cover 82' attached such as by screws or other known fasteners. The side frame members 70 integrally form the seat-depth-adjustment structure by the bearing arrangement shown in FIGS. 4A and 4B. Notches (not specifically shown) can be formed along the side frame members 70 and a seat depth latch can be operable positioned on the perimeter frame 69 for selectively engaging the notches to hold a selected seat depth adjusted position. (See the application Ser. No. 10/792,309, previously incorporated by reference.) Alternatively, a fixed attachment is used if seat depth adjustment is not desired. Notably, the illustrated perimeter frame 69 is surprisingly flexible and twistable in a direction perpendicular to the top seating surface when it is not attached to the seat-supporting structure 36, for reasons described below. Nonetheless, the seat-supporting structure 36 adds considerable strength against twisting-type flexure of the seat. The illustrated side frame members 70 define a series of pockets 83 and curved chute-like bearing surfaces 84. Resilient spring wire supports 85 have linear sections 86 that extend across the opening 81, and have L-shaped ends 87 that extend downwardly into the pockets 83. In an unstressed condition (FIG. 1B), the L-shaped ends 87 are near or abut an outboard end of the pockets 83. When a seated user rests on the linear sections 86 of the wire supports 85, the ends 87 are drawn toward each other. Notably, the pockets 83 permit inward movement of the ends 87 without inwardly stressing the opposing sides of the perimeter frame 69. (Notably, if the inward movement of the ends 87 were immediately resisted by the perimeter frame 69, there would be incredible pressure on the perimeter frame 69, due to the mechanical advantage caused by drawing the ends inward as a straight wire is bent in its middle area.) Because of the reduced strength requirement in the perimeter frame 69, its cross-sectional size can be reduced from chairs where a tensioned fabric is stretched across an opening in a seat frame.

Figure 10B:
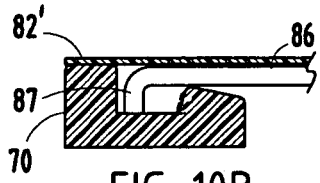
FIG. 10D is a view similar to FIG. 10B, but showing a modified wire support.
Figure 10C:
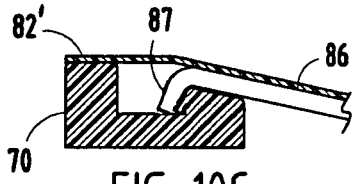

The surfaces (FIG. 10C) on the inboard end of the pockets 83 acts as a limit to inward movement of the L-shaped ends 87 in the event of substantial weight on one or more individual wire supports 85 (such as if a person stands on the seat 23). Notably, surfaces on the outboard ends of the pockets 83 can, if desired, be foreshortened and used to abut the L-shaped ends 87 to provide a pre-form or pre-stressed condition in the wire supports 85. Also, the wire supports 85 can be pre-bent to a desired non-linear shape if desired for spanning across the opening 81. The illustrated wire supports 85 are individual, spring metal and round in cross section, but it is contemplated that they can be loop-shaped or serpentine in shape or other shape, can have a flattened or other cross-sectional shape, and can be metal, plastic, composite, or other material.

Figure 10D:
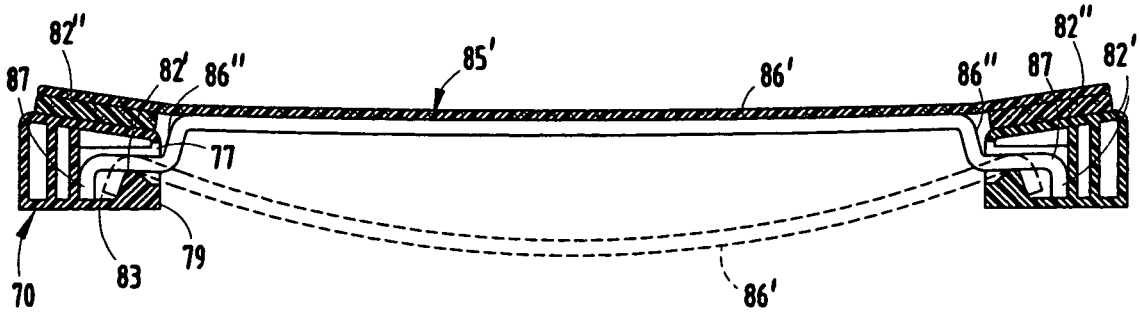

As noted below, a transition area is defined by rearward flange 93 along a front edge of the opening 81. It is noted that the wire supports 85 can be modified to reduce the need for lowering the flange 93. Specifically, the modified wire support 85' (FIG. 10D) includes an S-shaped bend at location 86" causing the linear section 86' to be elevated. This allows a thicker foam to be used on the cover 82' to improve seating comfort on the perimeter frame 69, while allowing a thin foam (or zero foam) on the wire supports 85. Notably, it is desirable to minimize the amount of foam on the wire supports 85 since "too much" foam would detract from the active independent support provided by the individual wire supports 85. This modification also allows for different design alternatives. For example, a cushion sheet 82" of uniform thickness can be rested on the cover 82', with the top surface of the cushion sheet 82" generally aligning with a top surface of the wire linear sections 86'. (See FIG. 10B.) A sheet of upholstery or fabric (not shown in FIG. 10D) can be laid on the foam cushion and stretched across the seat to cover both the cushion sheet 82" and the wire linear sections 86'. In the arrangement of FIG. 10D, the center area of the rear flange 93 does not need to be lower than the side areas.

Figure 12:
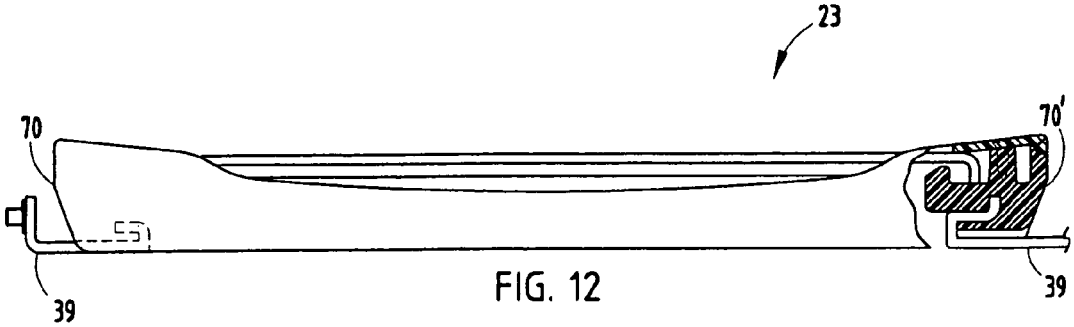
FIGS. 11-12 are top and front views of the seat of FIG. 3.
Figure 11:
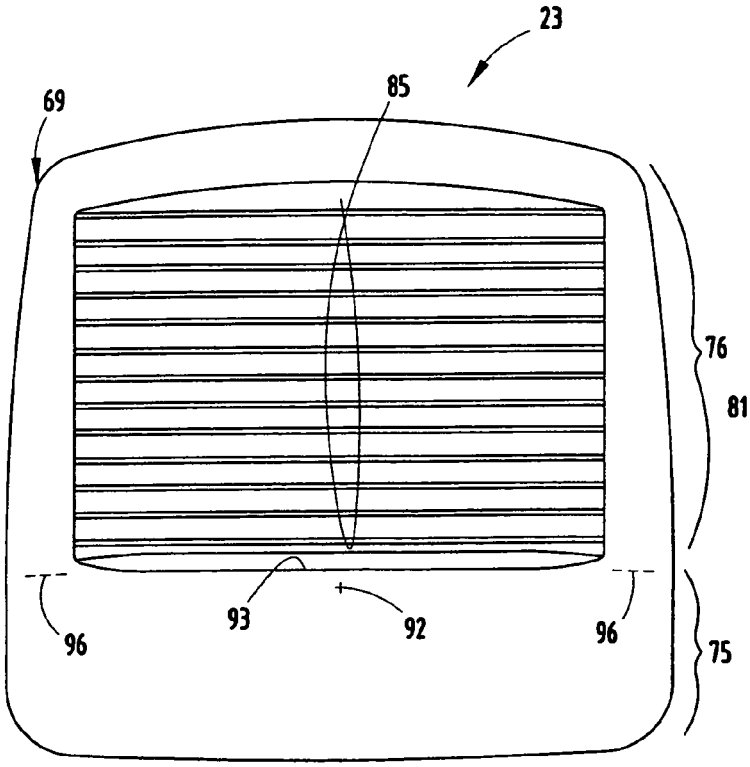
Figure 13:
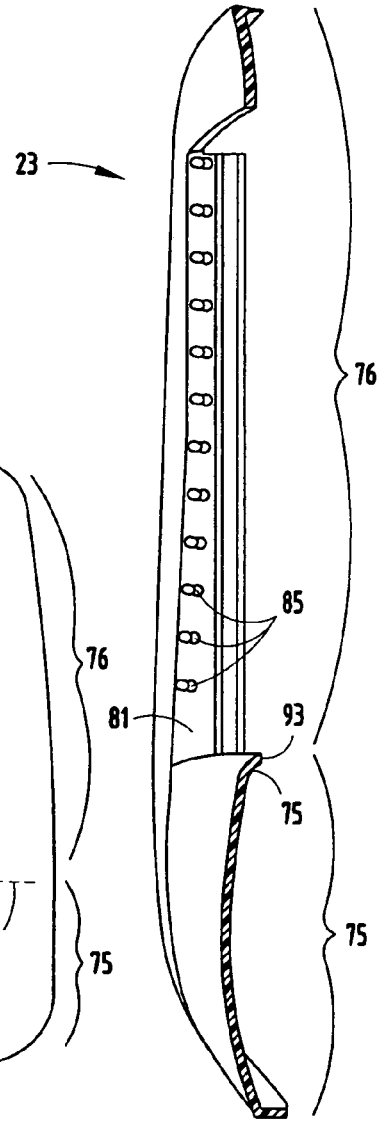
FIG. 13 is a cross section taken along a center of FIG. 11.

The transition between the front and rear portions 75 and 76 is very important, given the flexibility and physical structure of the rear portion 76, including its perimeter frame 69 and the flexible resilient wire supports 85. This is especially true considering the angular adjustability of the front portion 75 on the rear portion 76, as discussed below. As illustrated in FIGS. 11-13, the front portion 75 (FIG. 13) has a "waterfall" shape, with its top surface being curved rearwardly and downwardly toward the opening 81 in the perimeter frame 69, and further it is curved forwardly and downwardly toward a front edge of the seat 23. A center rear region 92 of the front portion 75 is lower than edge portions, especially as the top surface curves toward the opening 81. In particular, the center rear region 92 can be up to an extra half inch below the top surface of the wire supports 85. Further, the rearwardly-extending flange 93 forming the rear edge facing the opening 81 is curved downwardly to form a transition that enhances comfort to a seated user who is slouching (i.e. where the person's weight is directed at an angle from a middle of the back 22 across the opening 81 and against the flange 93). Also, the lowering of the thigh area by one half inch below the wires 85 improves the transition thigh comfort and perching comfort by allowing for an extra half inch of foam in this area. The lowered area is only in a center region of the front portion 75 for aesthetic reasons.

Figure 2:
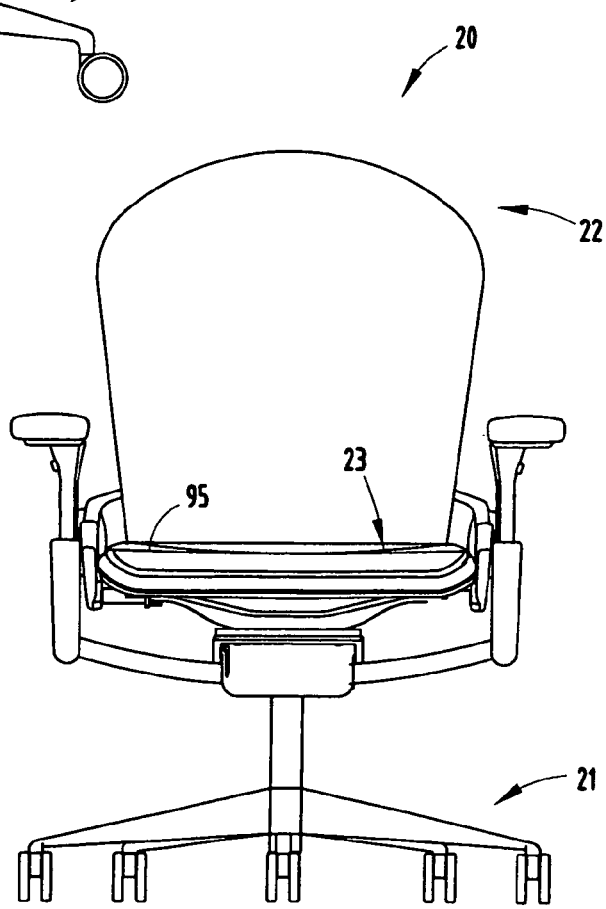

A cushion and/or fabric covering 95 (FIGS. 1-2) is placed on the seat 23, and is attached at its front and rear edges to the seat 23. A stiff strip (not specifically shown) is attached along front and rear edges of the illustrated fabric 95 and extends completely across the front and rear edge. The stiff strips are shaped to frictionally tuck into a channel in the front and rear portions 75 and 76. The present description is sufficient for a person skilled in chair design, but additional details are disclosed in the patent application Ser. No. 10/792,309, previously incorporated by reference to the extent they are necessary.

Figure 8:
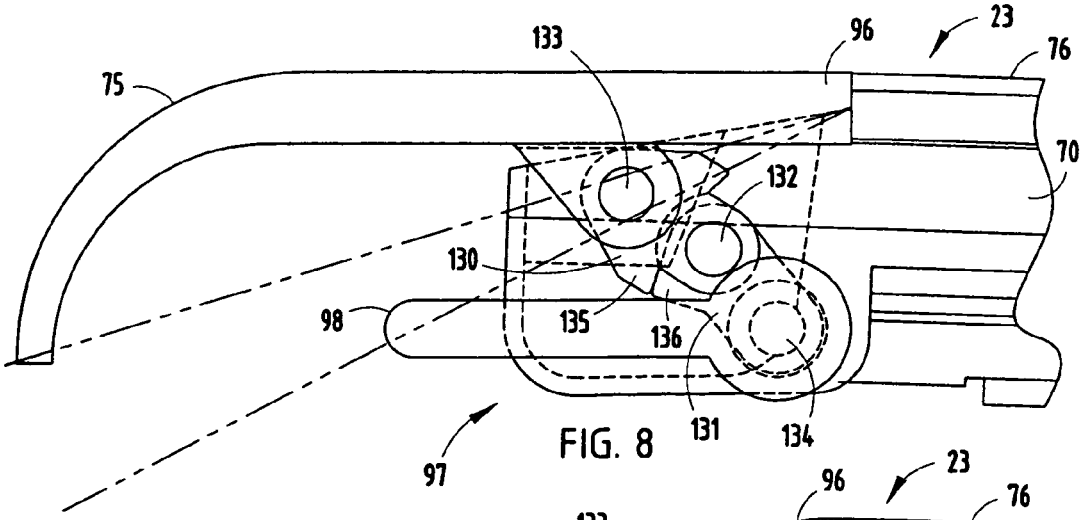
FIGS. 8-9 are fragmentary cross sections taken across a front of the seat similar to FIG. 5, FIG. 8 showing a thigh angle adjuster on the seat in a "normal" raised position, and FIG. 9 being in a "down-adjusted" lowered position.

The front portion 75 (FIG. 8-9) includes a flexible region 96 connecting it to the rear portion 76. It is contemplated that the front portion 75 could be pivotally or slidably connected to the rear portion 76 as well. An adjuster 97 is mounted to change an angle of the front portion 75 relative to the rear portion 76. The illustrated adjuster 97 includes a pair of links 130 and 131 on each side of the chair fit within a pocket at a front of side frame members 70 and 70' (FIG. 3). The links 130 and 131 (FIG. 8) are pivoted to each other at pivot 132. The upper link 130 is pivoted to the front portion 75 at pivot 133 and the lower link 131 is pivoted to the associated side frame member 70. When moved over-center in a first direction (FIG. 8), stops 135 and 136 on the front portion 75 and the lower link 131 engage to limit rotation of the links 130 and 131. This causes the front portion 75 to stop in a first thigh-angle-supporting position. When moved over-center in a second direction (FIG. 9), stops 137 and 138 on the front portion 75 and the lower link 131 engage to limit rotation of the links 130 and 131. This causes the front portion 75 to stop in a second thigh-angle-supporting position. Thus, the adjuster 97 provides a two-position adjustment for the front portion 75 of the seat.

A modified adjuster 97' (FIG. 9A) is pivotally mounted by a pivot pin 98 to a mounting structure on a front of the side frame members 70'. The adjuster 97' includes a handle 98" and a spiral slot 99' that engages a guide pin 100' in a side of the front portion 75. The spiral slot 99' defines an increasing radius about the axis of the pivot pin 98'. The guide pin 100' is located forward of the flexible region 96 so that, as the adjuster 97' is rotated, the guide pin 100' follows the slot 99' and forces the front portion 75 angularly downwardly. (See FIG. 9A which shows a home or "normal" position in solid lines, and which shows a downwardly-adjusted position in dashed lines.) Thus, the adjuster 97' is operably attached to the front end of the side frame members 70 and to the front portion 75 for adjusting the front portion 75 between a first angled position (solid lines) for supporting the thighs of the seated user in a first use position and a second angled position (dashed line) for supporting the thighs in a second lower use position, and is movable to any position therebetween, thus providing infinite adjustability. Notably, the adjuster 97' can include slight continuous friction along its adjustment path, or it can include a plurality of detent bumps along the path to define discrete thigh angle positions.

Figure 9:
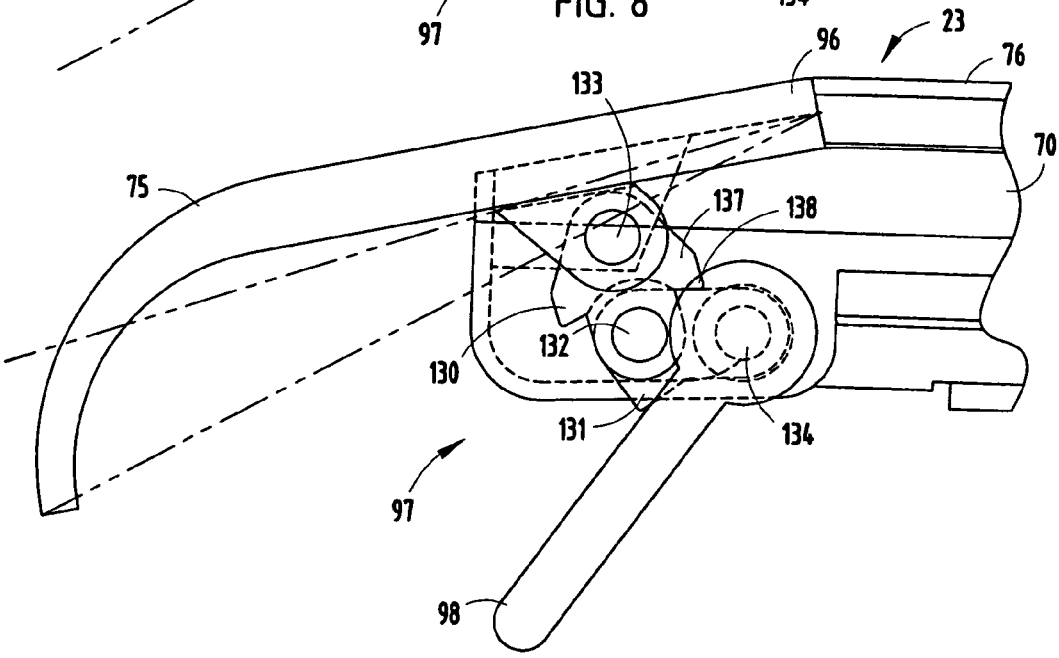
Figure 9A:
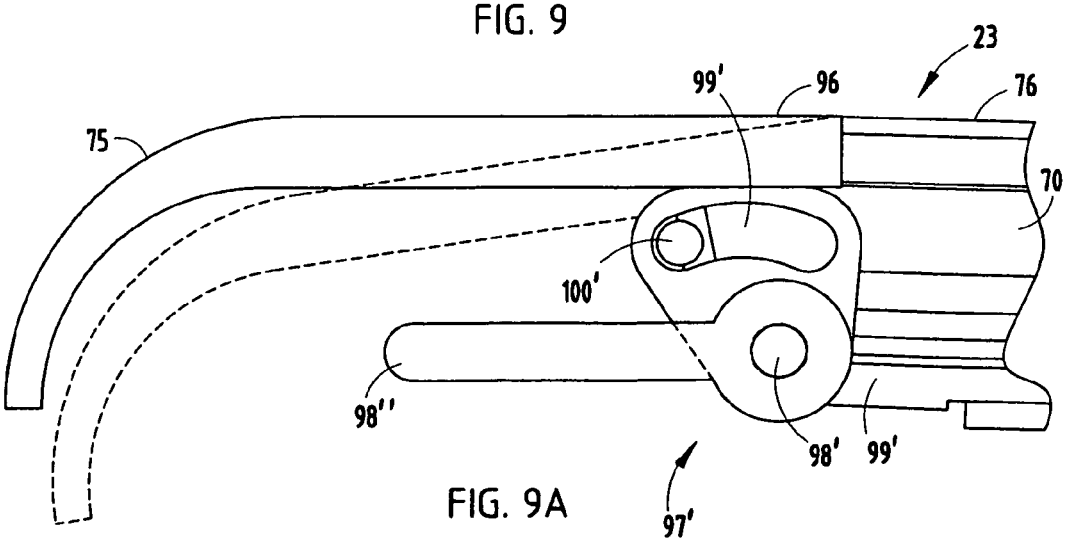
FIG. 9A is a view similar to FIG. 8 but of a modified thigh-angle adjuster that is infinitely adjustable.

The handle 98 of the adjuster 97 (FIG. 8) (and also handle 98" of adjuster 97') is elongated and has a flat surface that correlates to and generally aligns with the angular position of the front portion 75 when the front portion 75 is in either of its up position (FIG. 8) or down position (FIG. 9). Thus, a seated user immediately knows how the front portion 75 is adjusted, without having to move the handle 98 between positions. The seated user can tell where the adjuster 97 is set by feeling the handle 98 or by looking at the handle 98.

Figure 14:
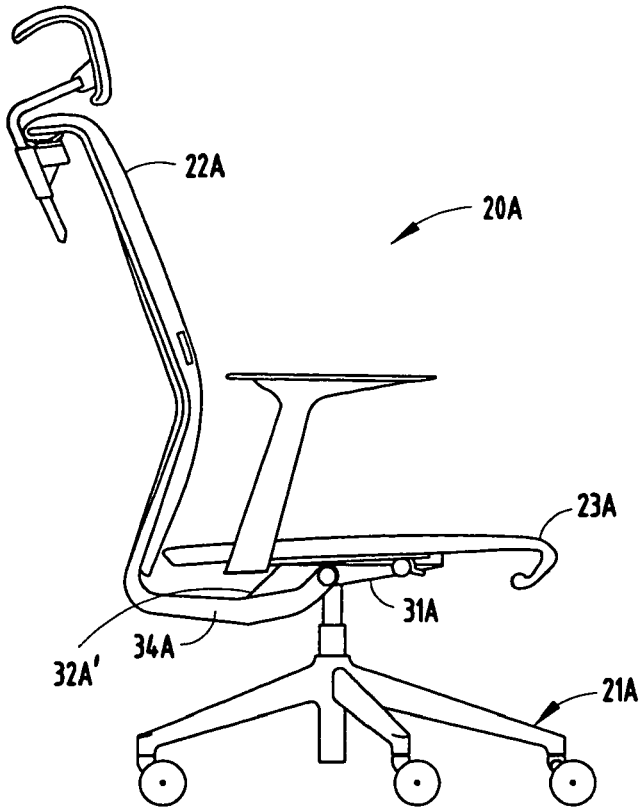
FIG. 14 is a side view of a second seating unit embodying aspects of the present invention.

A modified seating unit 20A (FIGS. 14-15) includes many similar features and aspects of the seating unit 20. In seating unit 20A, similar and identical components and features are identified by using the same identifying numbers but with the addition of the letter "A". This is done to reduce redundant discussion. The seating unit 20A is close to the seating unit disclosed in the application Ser. No. 10/792,309 previously incorporated herein by reference. The seating unit 20A is included herein to show a flexibility of the present inventive concepts, including especially the crossbar (37) and side frame sections (39).

Figure 15:
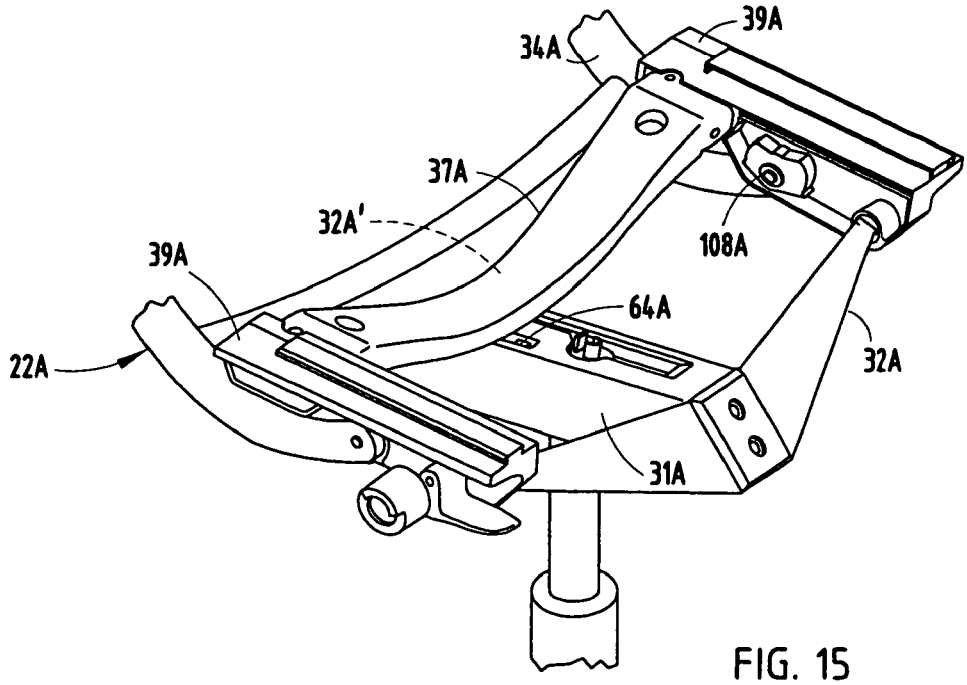
FIG. 15 is a perspective fragmentary view of the base of FIG. 14.
Figure 16:
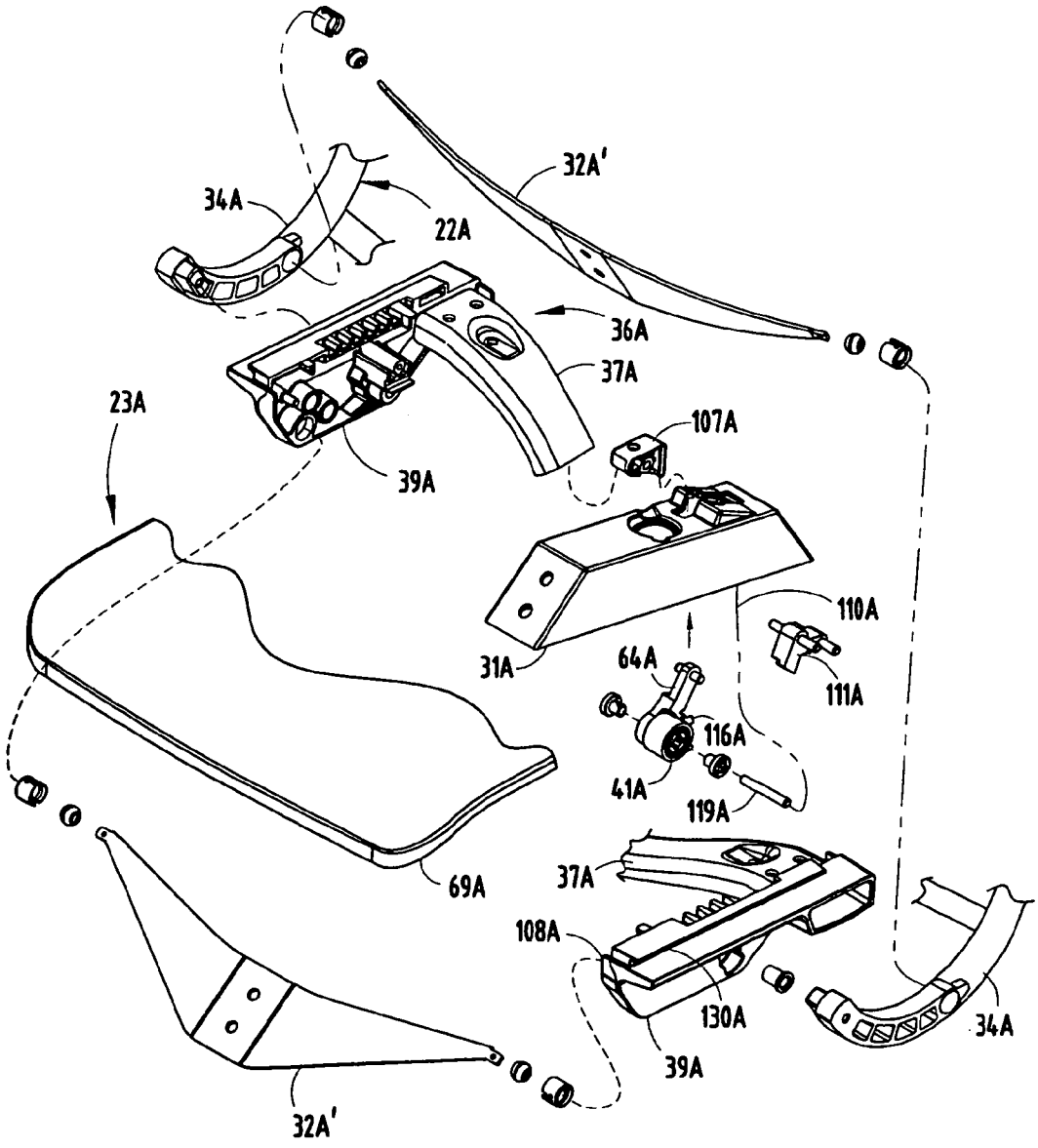
FIG. 16 is an exploded perspective view of FIG. 15.

The seating unit 20A (FIG. 14) includes a base 21A having a housing 31A with front and rear pairs of leaf-spring-like resilient support arms 32A and 32A' extending laterally and upwardly relative to each side of the housing 31A. A link arm 64A (FIG. 16) is pivoted to the housing 31A at a lower end by a pivot pin 119A. The seat 23A includes seat-supporting structure 36A in the form of crossbar 37A and side frame sections 39A (FIG. 15). The seat 23A is similar to the previously described seat 23, and includes a seat perimeter frame 69A for supporting a seated user. Addition detail will not be repeated, but it is noted that the application Ser. No. 10/792,309 provides additional discussion and was incorporated by reference above. An upper end of the link arm 64A is pivoted to the crossbar 37A at a pivot location defined by bracket 107A, and a rear end of the side frame sections 39A are operably rotatably engaged with the ends of the support arms 32A at locations 108A. This creates a non-aligned three-point support arrangement for supporting the seat-supporting structure 36A on the base 21A. The seat 23A is slidably positioned on the side frame sections 39A for depth adjustment on flanges 130A on side frame sections 39A that slidably engage mating flanges on the seat frame 69A. A latch is positioned between the seat frame 69A and side frame sections 39A to permit seat depth adjustment.

The back 21A (FIGS. 14-15) includes downwardly and forwardly extending arms 34A supported on ends of the rear support arms 32A'. Further, the back-supporting arms 34A are pivoted at location 108A to the side frame sections 39A. The rear resilient support arms 32A' are held at a forwardly tilted angle and the front resilient support arms 32A are held at a rearwardly tilted angle. Due to the interaction of forces, the result is that, upon recline of the back 22A, the arms 32A and 32A' flex, causing the seat 23A moves forwardly and upwardly (the front edge of the seat moving linearly and a rear edge of the seat moving arcuately about the pivot pin 119A described below).

Figure 17:
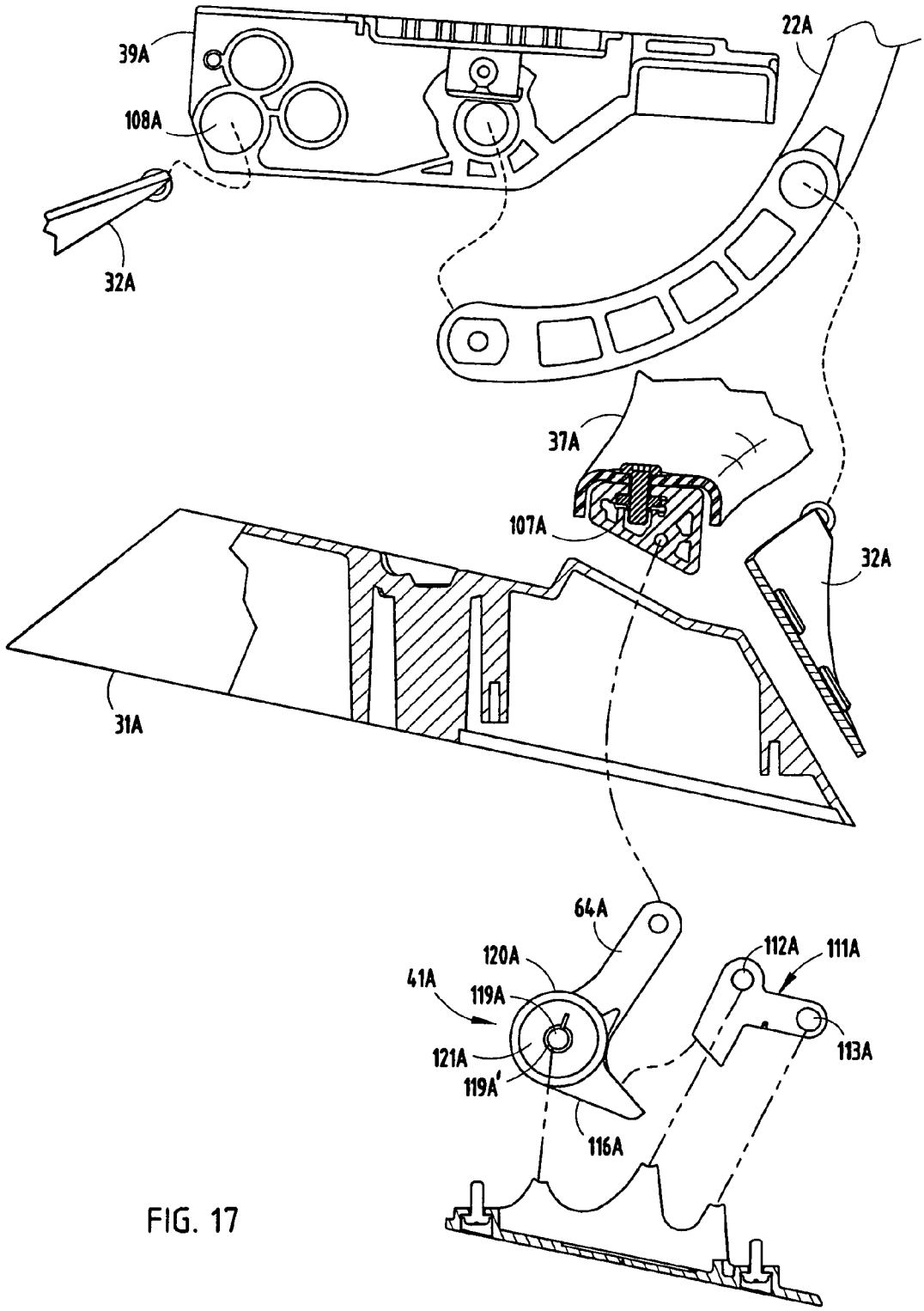
FIG. 17 is an exploded side view of FIG. 15.
Figure 18:
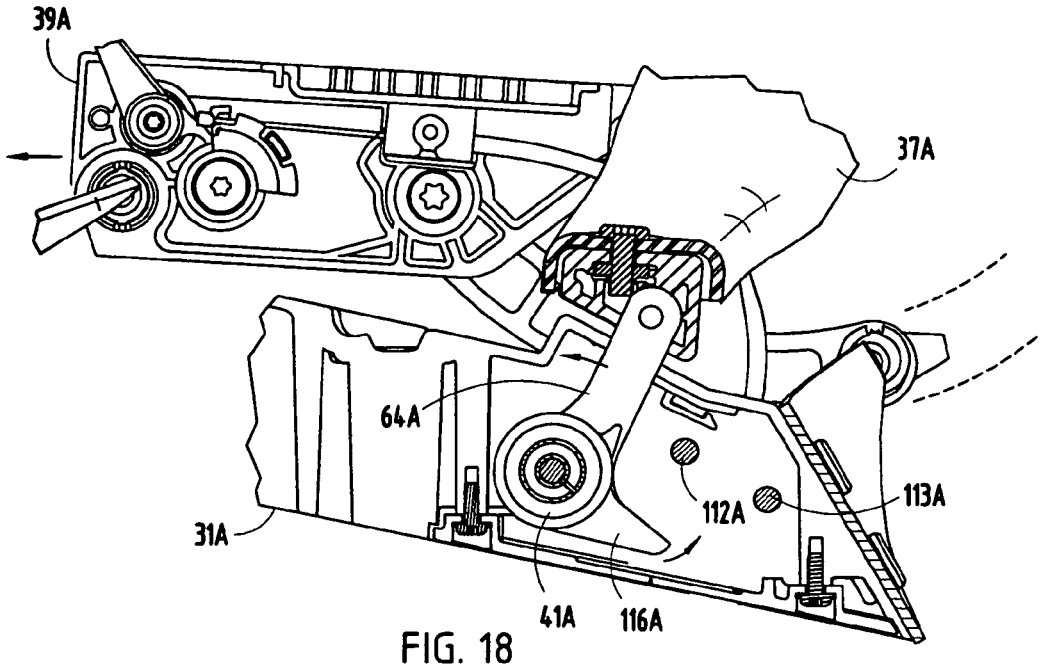
FIGS. 18-19 are side views showing operation of the selectively-operable booster spring mechanism of FIG. 16.
Figure 19:
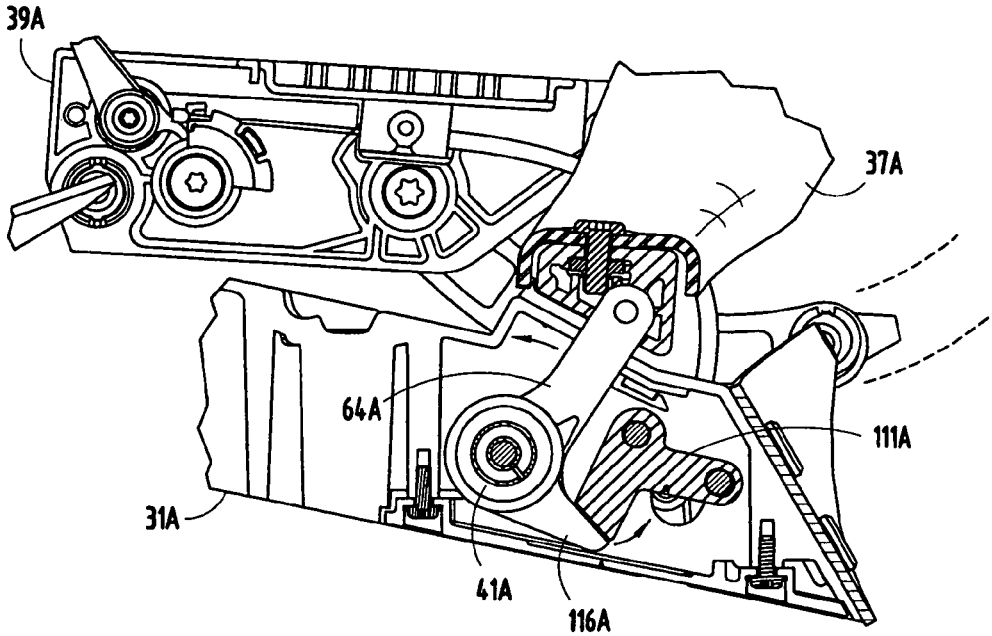

A selectively-engaged force-generating device in the form of a torsion spring 41A is positioned within the housing 31A on the pivot pin 119A for rotation about an axis 110A. The torsion spring 41A (FIG. 17) includes an inner ring member 119A' keyed to the pivot pin 119A. Since the pivot pin 119A is keyed to the movement of the link arm 64A, as the seat 23A moves during recline of the back 22A, the link arm 64A also is forced to move. Thus, the link arm 64A rotates in a synchronized coordinated fashion with the back 22A when the back 22A is reclined. The torsion spring 51A further includes an outer ring 120A with a radially-extending interference leg 116A, and a rubber torsion spring element 121A between the inner and outer ring members 118A and 120A. A selector stop member 111A is positioned on a pair of guide rods 112A and 113A within the housing 31A for lateral sliding movement via a Bowden cable and a remote control handle on a side of the seat 23A. When the selector stop member 111A is in a first position (FIG. 18), the selector stop member 111A does not engage the interference leg 116A on the torsion spring 41A but instead misses the leg 116A. As a result, the leg 116A (and spring 41A) is free to rotate, and does not provide any back support upon recline. Instead, the back support upon recline comes from the upward and forward movement of the seat 23A during recline (which is a weight-activated support feature where heavier seated users receive greater back support due to their heavier body weight), in combination with the energy-absorption that occurs by flexing of the resilient arms 32A and 32A'. Since the torsion spring 41A freely rotates, the torsion spring 41A is not active, and does not provide any bias during recline of the back 22A. Contrastingly, when the selector stop member 111A is moved to a second position (FIG. 19), the selector stop member 111A engages the outer leg 116A, preventing the outer ring 120A from rotating. At the same time, the keyed inner ring member 118A moves with the pivot pin 119A since it is keyed to the pivot pin 119A. This causes the torsion spring element 121A to be stretched and to provide a biasing force, called a "booster" force herein since it "boosts" (i.e. in other words increases) the amount of energy provided upon recline of the back 22A.

Figure 20:
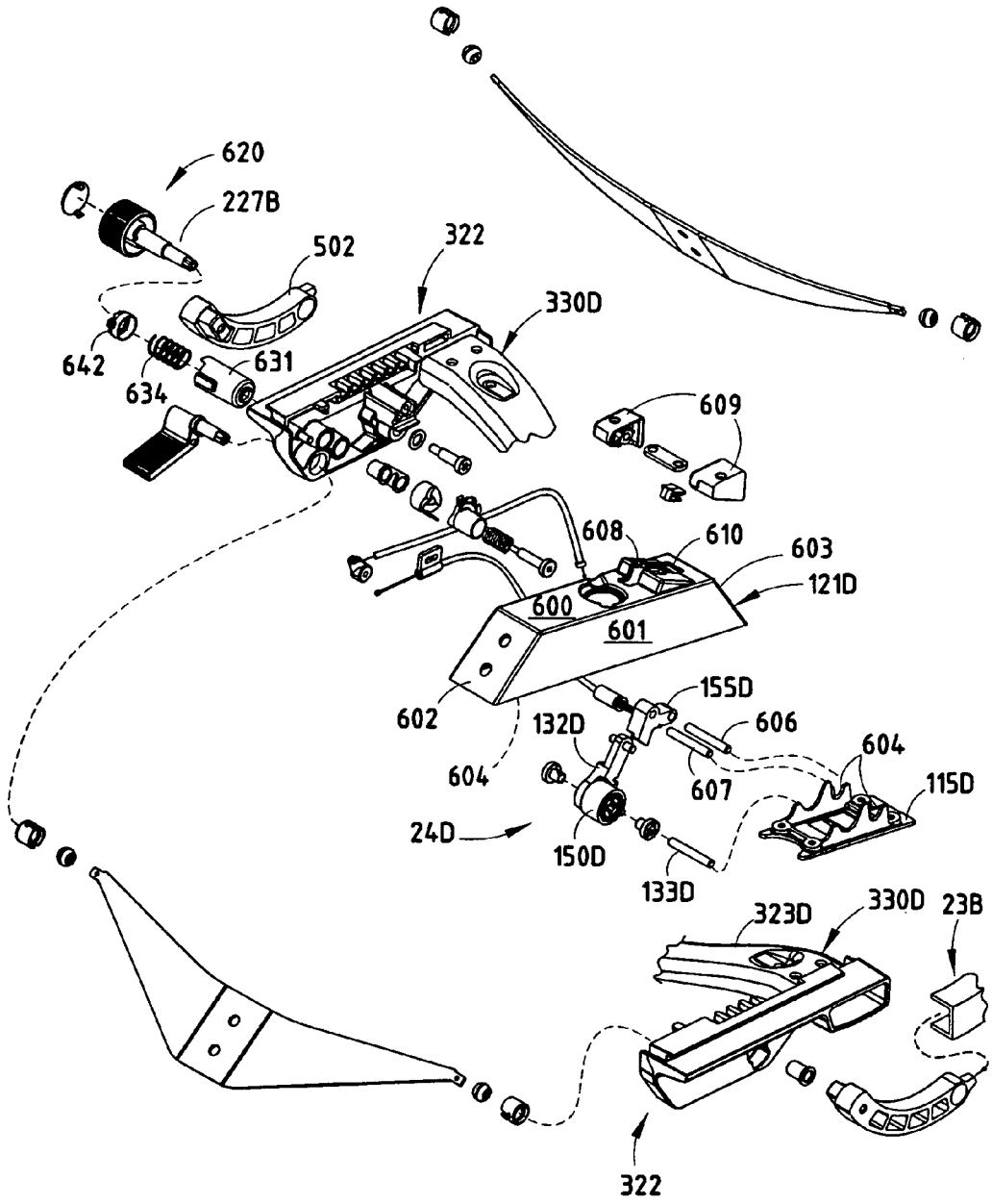
FIGS. 20-21 are perspective and side exploded views of the control of FIGS. 16-19.
Figure 21:
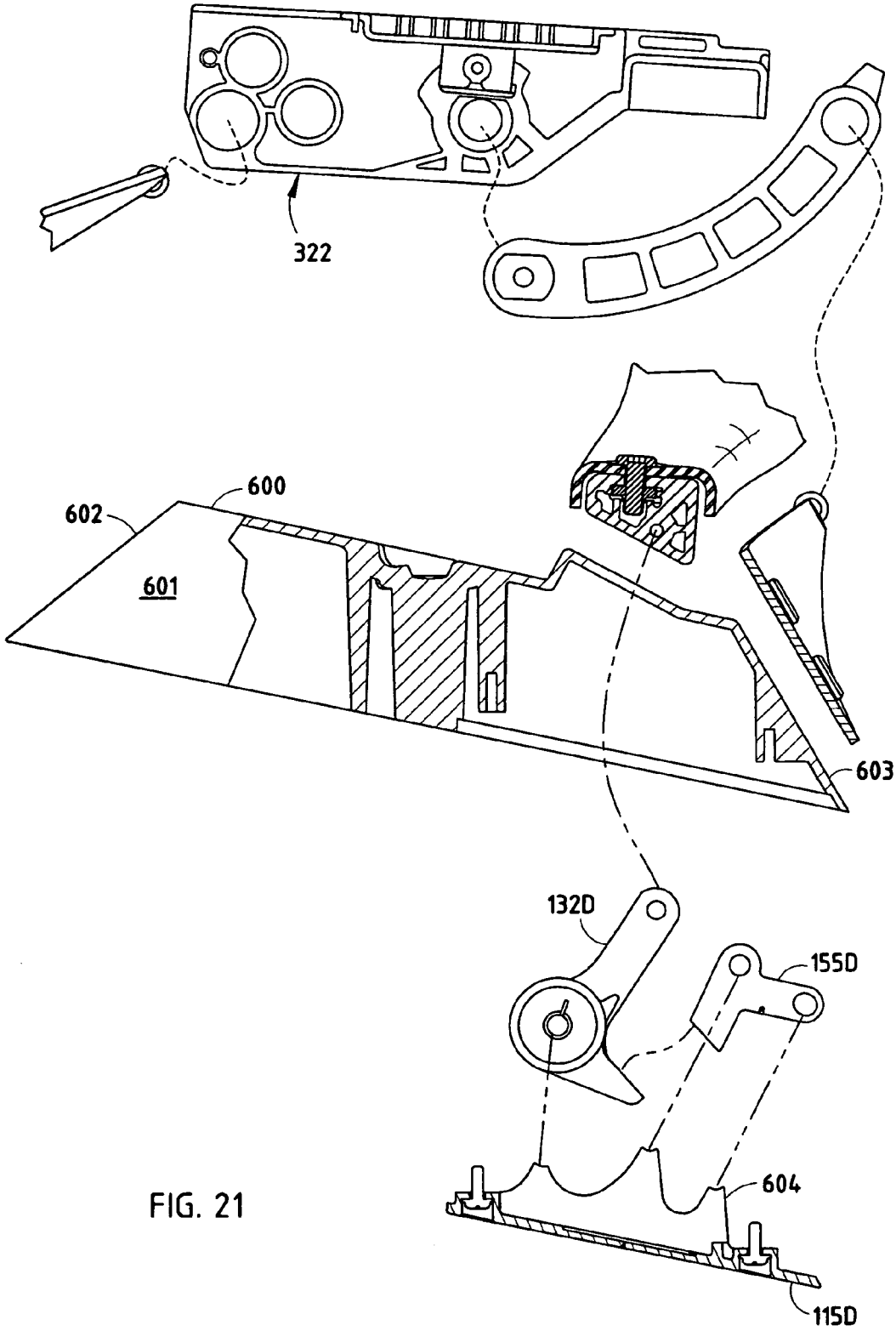

The modified control mechanism 24D (FIG. 20) includes a housing 121D with top, side, front and rear walls 600-603 defining a downwardly open cavity 604 closed by cover 115D. Up flanges 604 on the cover 115D combine with features inside the housing 121D to retain the axle-forming pivot pin 133D (recall that pin 133D is supported in the housing 121D and rotatably supports the seat-attached link 132D and rotatably supports the torsional booster spring 150D), and the features are also used to retain the parallel rods 606 and 607 for slidably supporting the stop member 155D. The top wall 600 includes a raised area 608 for abutting a triangular mount 609 attached to the cross beam 323D of the seat frame 330D, and further includes a slot 610 for receiving an upper arm 132D' on the link 132D.

Figure 22:
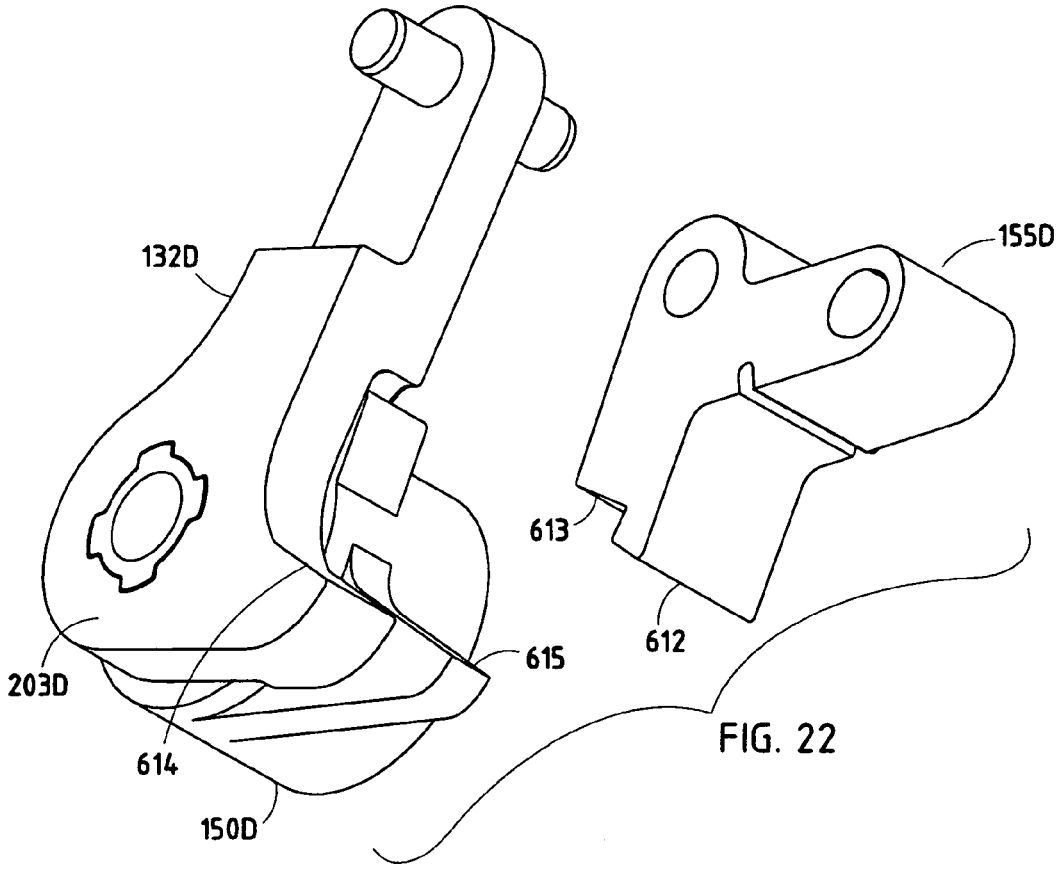
FIGS. 22-22A are top and bottom perspective views of the control components including the laterally-slidable stop member, the seat-supporting link, and the booster spring of FIG. 20.
Figure 22A:
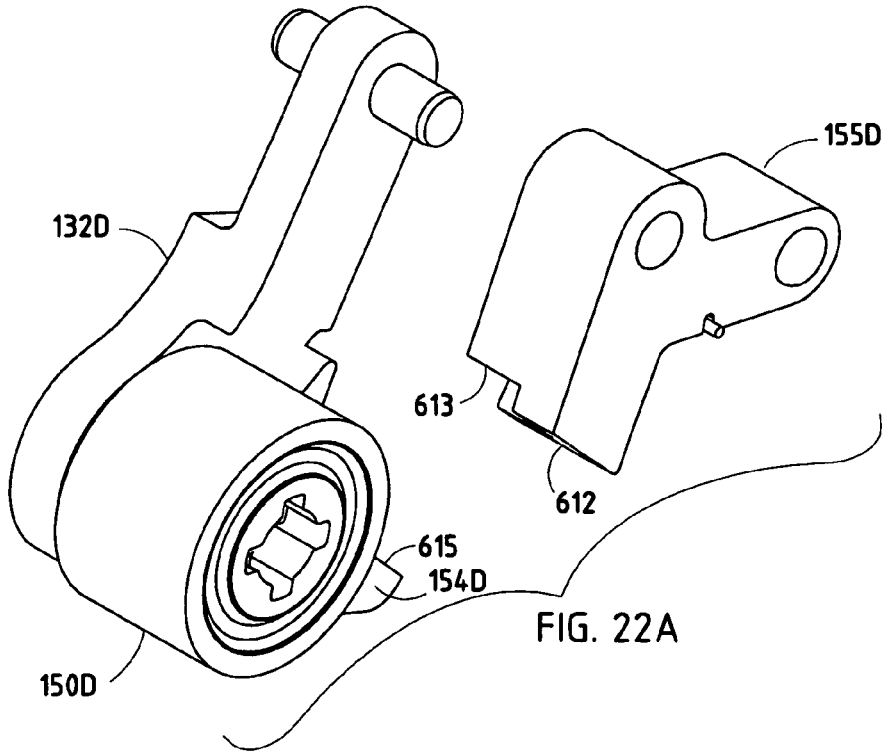
Figure 23:
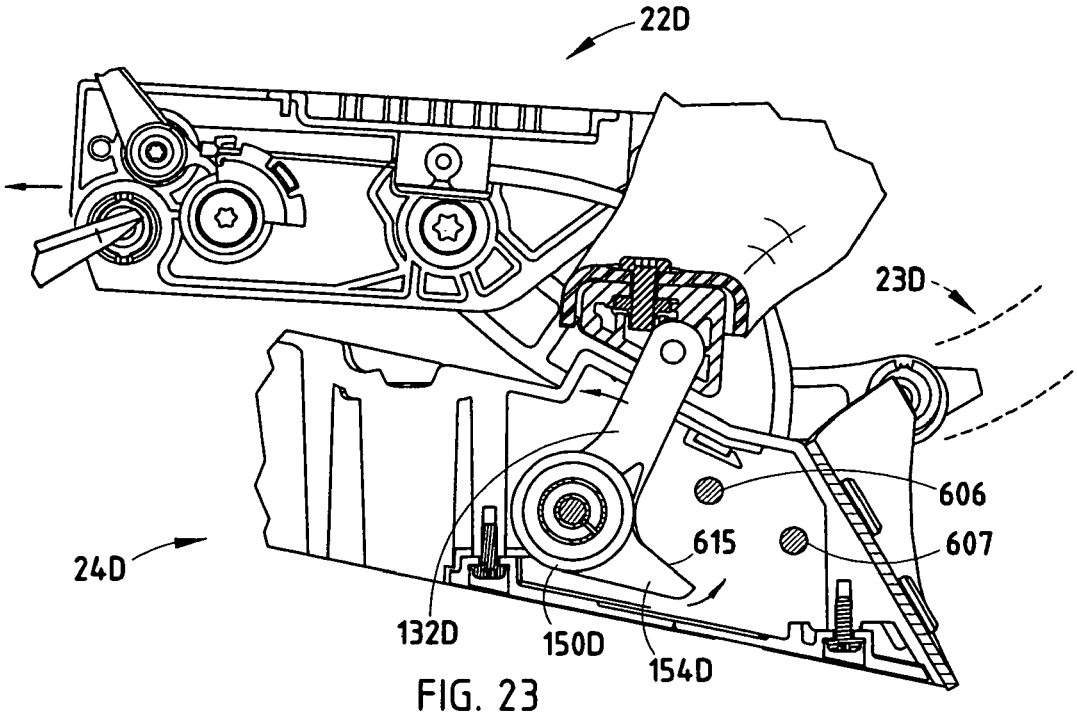
FIGS. 23-26 are side cross-sectional views showing operation of the control components including the components of FIGS. 22-22A.

The stop member 155D (FIGS. 20-22A) is slidably carried by rods 606 and 607 for laterally sliding movement. The stop member 155D includes first and second stop surfaces 612 and 613 (FIG. 22A), which are angularly stepped from each other to define different angular positions relative to the axle-forming pivot pin 133D. The link 132D (FIG. 22) includes a mating stop surface 614 on its arm 203D, and the torsional booster spring 150D includes a mating stop surface 615 on its outer sleeve's arm 154D. In a first (home) position (FIG. 23), the stop member (155D) is laterally shifted toward one side so that it is positioned out of the way, such that the stop surfaces 612 and 613 do not engage any mating surface. Hence, the back 23D is supported only by the energy stored in the compliant springs 123D' and 137D (and the potential energy stored as the seated user is lifted by the seat 22D during recline of the back 23D).

Figure 24:
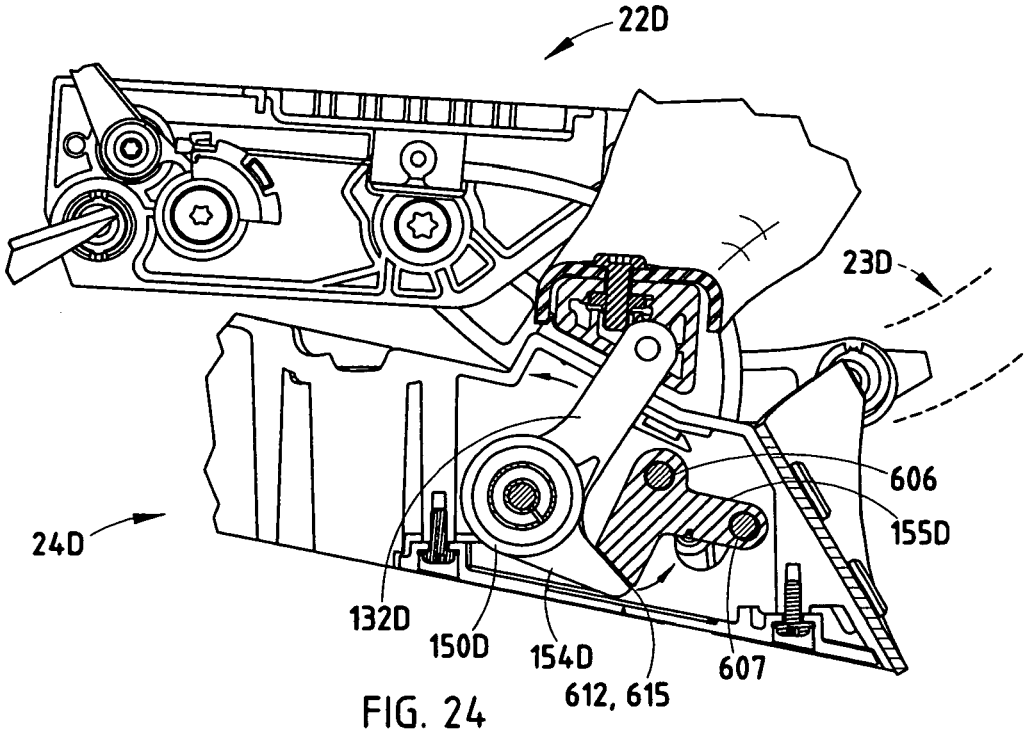
Figure 25:
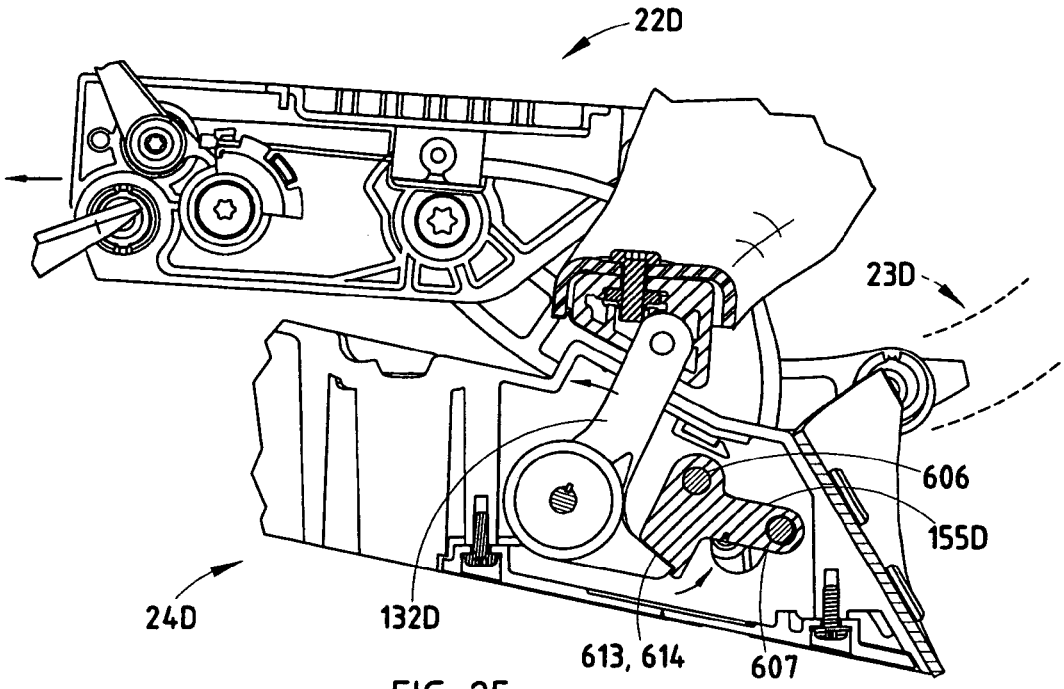
Figure 26:
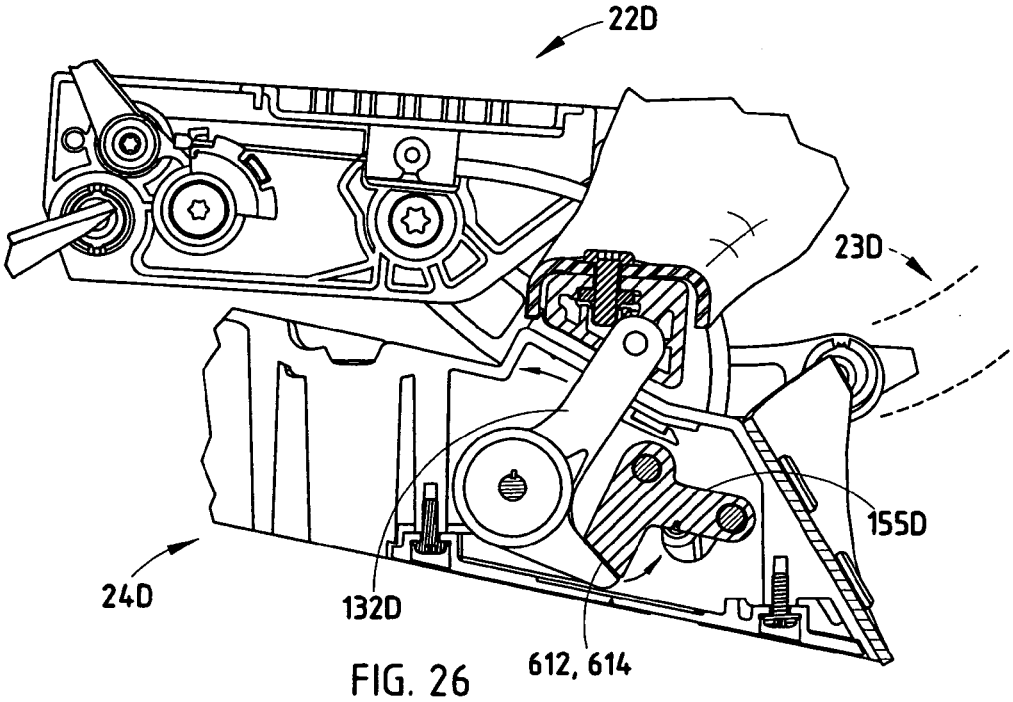

In a second position (FIG. 24), the stop surface 612 engages the stop surface 615 on the spring arm 154D, such that the booster spring 150D is engaged and supplements (i.e., adds to) the back supporting force during recline of the back 23D. Notably, the back 23D is permitted to move to a full recline position. In a third position (FIG. 25), the stop surface 613 engages the mating stop surface 614 on the link 132D. Since the stop surface 613 is angularly stepped from the stop surface 612, the back 23D is permitted a partial recline before the stop surface 613 engages the link's stop surface 614. Notably, the stop surface 612 of the stop member 155D engages the stop surface 615, such that the booster spring 150D is continuously engaged during this partial recline. In a fourth position (FIG. 26), the stop surface 612 engages the stop surface 614 of the link 132D, preventing any recline of the back 23D (i.e. "zero recline").

Advantageously, the only frictional force that must be overcome when moving the stop member 155D is the effort to slide the stop member 155D along rods 606 and 607, which is designed to have a very low frictional force. Thus, normally, a very low "shifting force" is required. It is contemplated that the shifting force for moving the stop member 155D can be provided by a Bowden cable with telescoping internal wire that is stiff enough to provide both a "push" shifting force and a "pull" shifting force.

Figure 27:
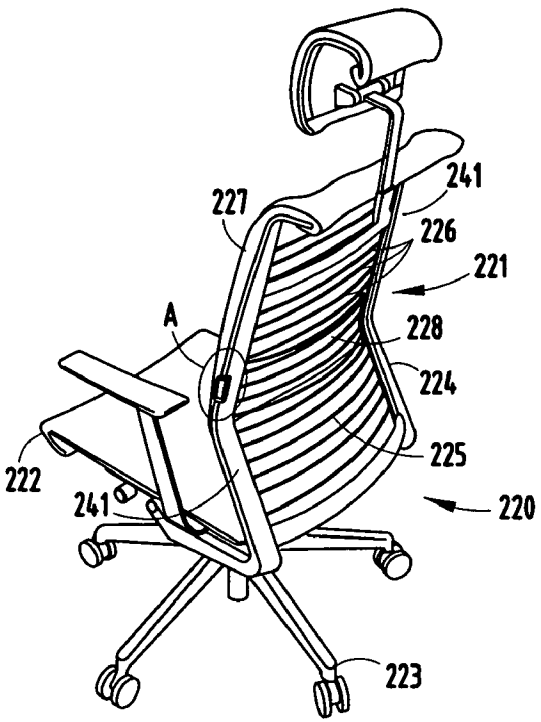
FIG. 27 is a perspective view of a seating unit including a lumbar device embodying the present invention.

A seating unit 220 (FIG. 27) includes a back support 221 and seat 222 supported for synchronous movement by a base 223. The back support 221 includes a perimeter frame 224 defining an opening 225, and includes a plurality of resilient members 226 (i.e., spring steel wires) spanning the opening for flexibly supporting a seated user. An upholstery cover 227 extends over and covers the resilient members 226 and covers a front of the perimeter frame 224. A bow-tie-shaped lumbar device 228 is positioned between the cover 227 and sides of the perimeter frame 224 for vertical adjustment. The lumbar device 228 includes a bow-tie-shaped flexible body 229 with end sections 230 defining a greater vertical dimension D1 than a middle section 231 of the body 229. Upper and lower edges 232 and 233 of the end sections 230 are thin and serve to wedgingly slip between the cover 227 and the resilient members 226 in a manner leading the middle over irregular surfaces between the resilient members 226. A thick middle area between the upper and lower edges 232 and 233 causes a change in lumbar support force and shape as the lumbar device 228 is vertically adjusted. Handles 235 are attached to the body 229 by stretchable fabric loops 236, permitting the handles 235 to track along non-parallel side frame portions of the perimeter frame 224 during lumbar adjustment.

Figure 34:
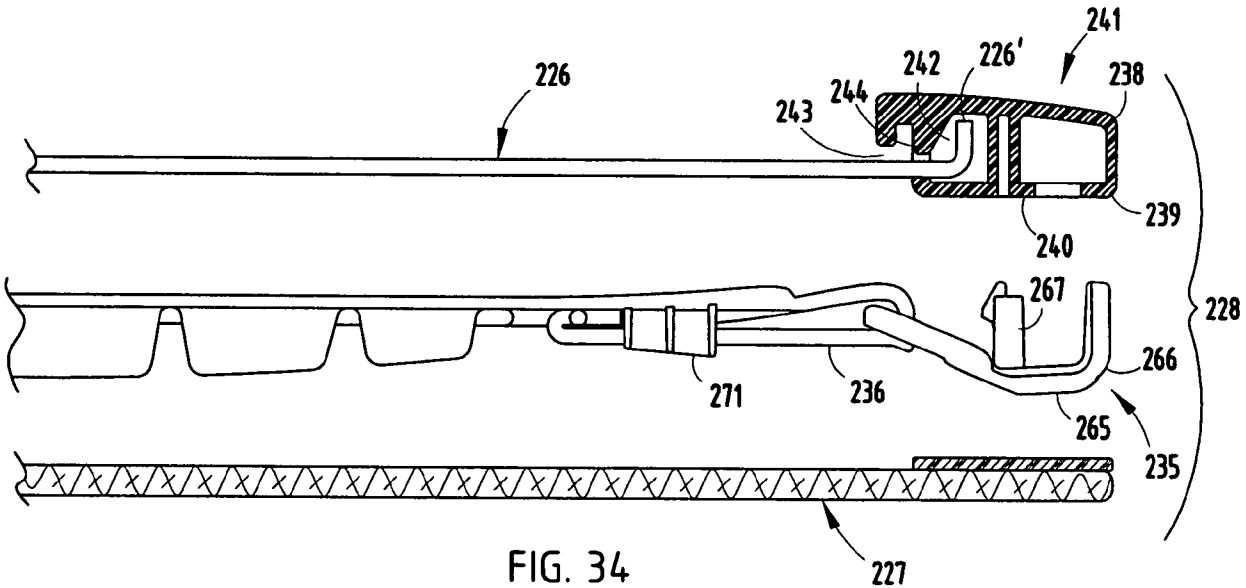
FIG. 34 is an exploded view of FIG. 33.

The perimeter frame 224 (FIG. 34) includes a lower perimeter member 238 and an upper perimeter member 239 attached to the lower perimeter member 238 by screws 240. The lower perimeter member 238 includes side frame sections 241 defining a plurality of pockets 242 that are elongated in a direction toward the opening 225 defined by the perimeter frame 224. The pockets 242 have an access opening 243 that opens across a radiused surface 244 on the lower perimeter member 238. The upper perimeter member 239 covers the access opening 243. The resilient members 226 are steel wires having an L-shaped end 226' positioned in the pockets 242 for sliding movement. The pockets 242 limit inward sliding motion of the resilient members 226. The ends of the resilient members 226 are operably mounted to slide as the resilient members 226 flex, thus providing distributed support for point loads (which is particularly comfortable to a seated user), while eliminating high inward stress on the side frame sections 241 as a middle of the resilient members 226 are rearwardly loaded. The present description is sufficient for a person of ordinary skill to understand the present invention, but it is noted that the details of the function and operation of the perimeter frame 224 and resilient members 226 are described in more detail in the application Ser. No. 10/792,309 incorporated herein by reference above.

The illustrated resilient members 226 are spring steel wires having round cross sections. However, it is contemplated that a scope of the present invention also includes other resilient support members, such as flat springs, non-metal plastic springs, springs made from composite materials, and other resilient support means.

Figure 28:
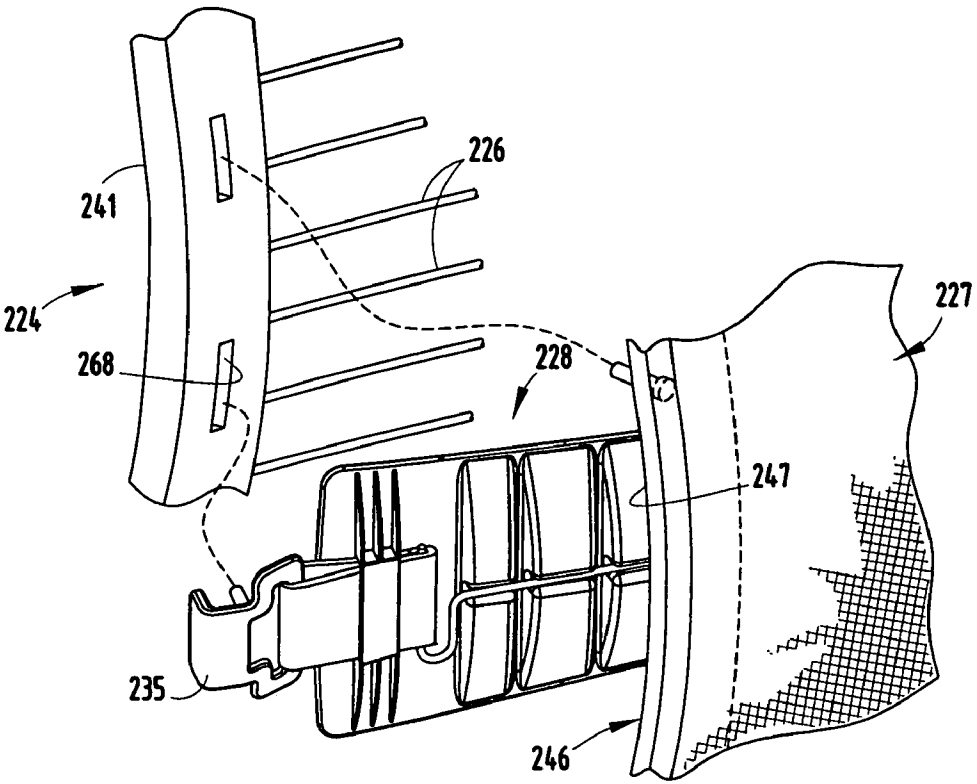
FIG. 28 is a fragmentary exploded view of a circled area "A" in FIG. 27.
Figures 28A, 29:
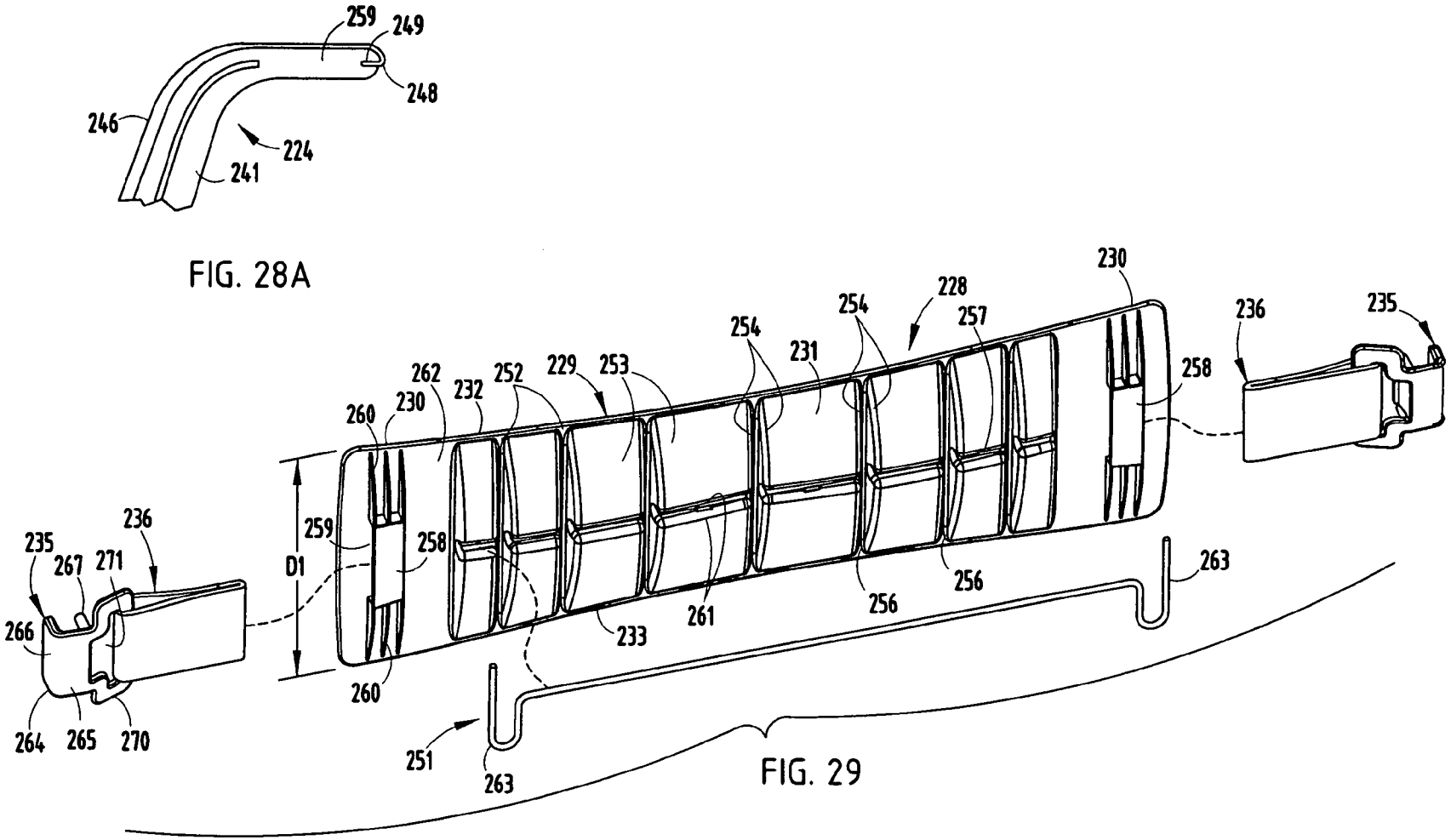
FIG. 28A is a side view of the upper portion of the back in FIG. 27.
FIG. 29 is an exploded perspective view of the lumbar device shown in FIGS. 27-28.
Figure 30:
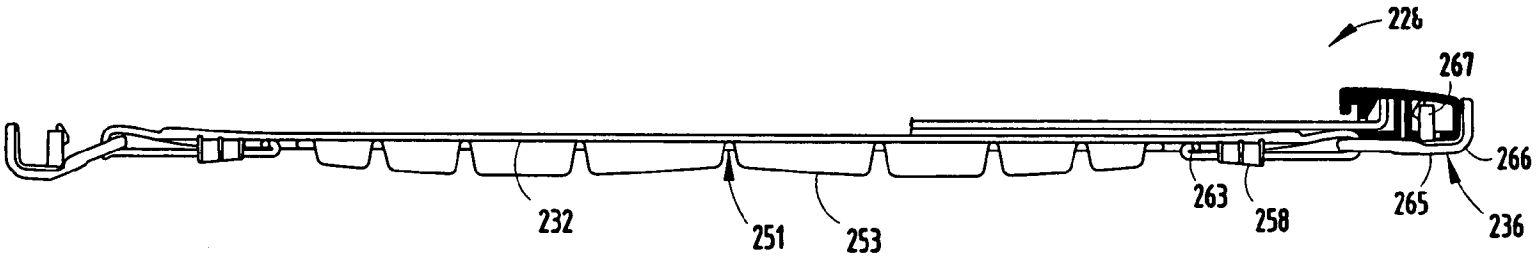
FIGS. 30-31 are top and front views of the lumbar device shown in FIG. 27, including fragments of the wire resilient members and side frame members of the back support.
Figure 31:
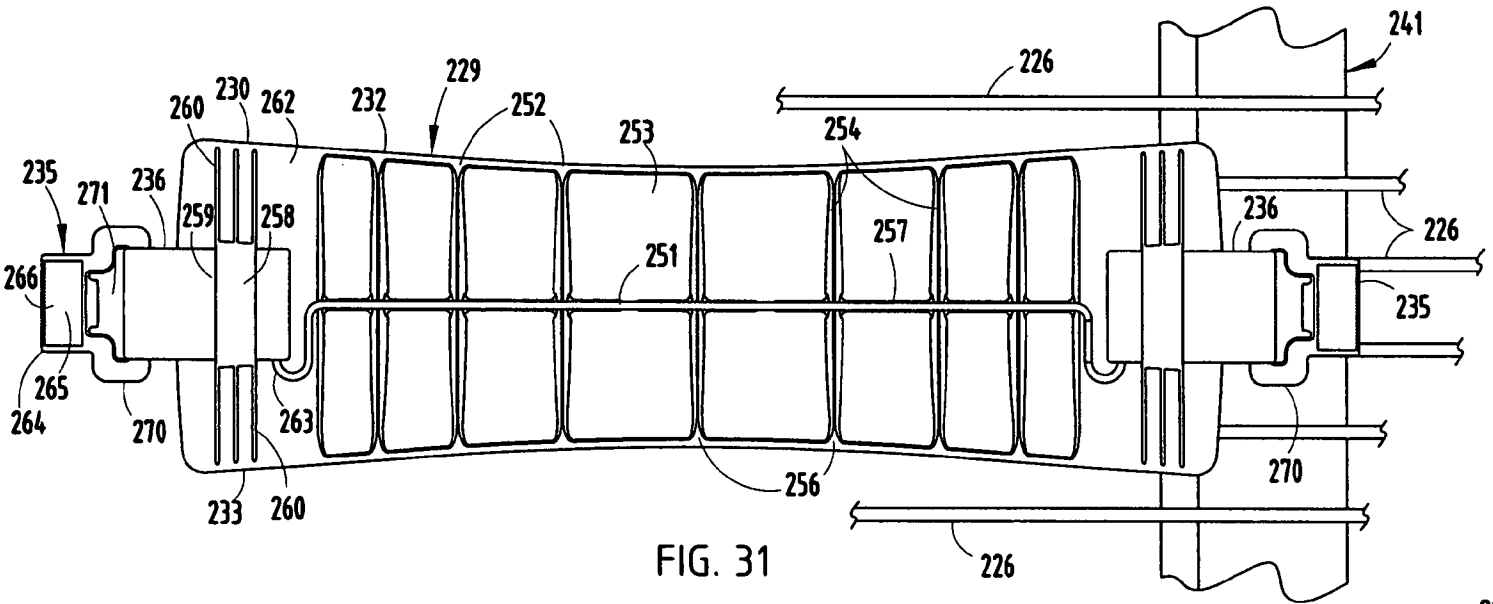
Figure 32:
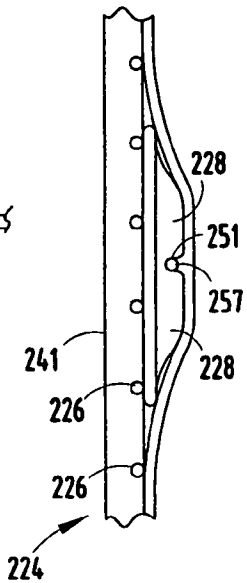
FIG. 32 is a cross section taken along line VI-VI in FIG. 33.
Figure 33:
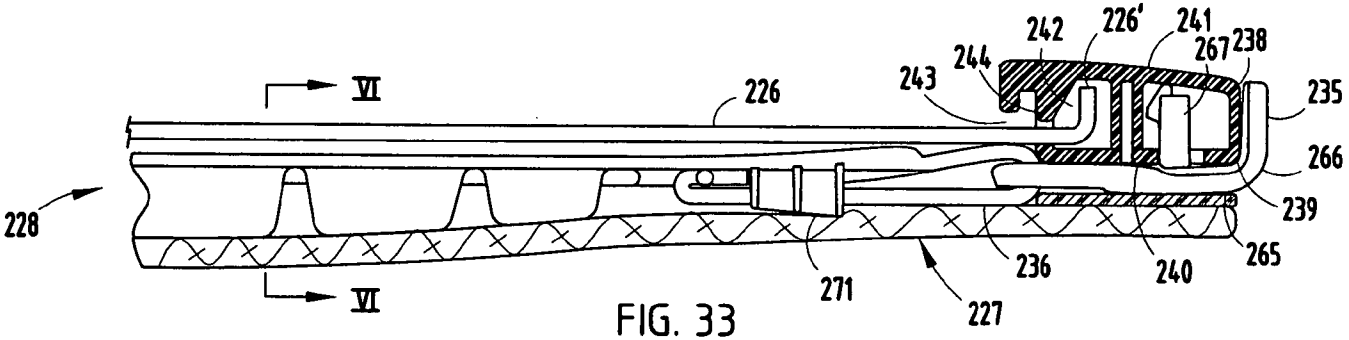
FIG. 33 is a cross section taken horizontally through the back at a location above the lumbar device in FIG. 27 and looking downwardly.

It is contemplated that the present cover 227 (FIG. 34) can be a variety of different materials for covering the perimeter frame 224 and resilient members 226. Notably, the resilient members 226 are sufficiently comfortable, such that it is not necessary that the cover 227 include a cushion or compressible material. However, the illustrated cover 227 includes a three-dimensional fabric known as a "technical material." The illustrated cover 227 includes first and second layers of woven material separated by resilient strands that connect the first and second layers to provide a cushioning member that provides air flow and that is recyclable. It is also contemplated that the cover 227 can be a subassembly of a foam cushion and fabric upholstery. A stiffener 246 (FIG. 28) is attached to a back surface of the cover 227, and includes side strips 247 that support and stabilize the edges of the cover 227. The stiffener 246 also includes top and bottom strips (not specifically shown) that form a perimeter around the entire cover 227 for stabilizing the cover 227. The top and bottom edges of the cover 227 are attached to the perimeter frame 224. This can be accomplished in a number of different ways. In the illustrated arrangement, a hooked ridge 248 (FIG. 28A) is attached to an edge of the cover 227, and is tucked into a mating channel 249 along an upper edge 250 of the perimeter frame 224 with a "zip lock" like action. A similar connection is provided at a bottom of the cover 227. The present description is sufficient for a person of ordinary skill to understand the present invention, but it is noted that the details of the function and operation of the cover attachment is described in more detail in the application Ser. No. 10/792,309 incorporated herein by reference above.

The lumber device 228 (FIG. 29) includes the body 229, and a wire 251 that connects fabric elastic loops 236 and handles 235 to the body 229. Specifically, the body 229 has a bow-tie shape formed by a unitary thermoformed (or injection-molded) sheet with vertically-enlarged end sections 230 defining a dimension D1 and a vertically narrower middle (when viewed in plan view). The body 229 has narrow upper and lower edges 232 and 233 and a thick middle section when viewed in side view from its end. The upper and lower edges 232 and 233 of the end sections 230 are limited to the thickness of the sheet material such that they are thin and serve to wedgingly slip between the cover 227 and the resilient members 226 in a manner leading the middle over irregular surfaces between the resilient members 226. Further, the edges 232 and 233 are near to the perimeter frame 224 where they are best able to slip between the cover 227 and the perimeter frame 224, even if a seated user is leaning against the back.

The body 229 (FIG. 29) is molded to have first wall portions 252 formed to define a first surface and second wall portions 253 formed to define a second surface. Third wall portions 254 extend between the first and second wall portions 252 and 253 to define space therebetween. The wall portions 253 and 254 form cube-shaped hollow blocks that look much like an ice cube tray (though they are triangularly-shaped when viewed from an end). The hollow blocks have sufficient strength to maintain their shape when compressed, with the wall portions 252 being a base layer that is relatively flat. The areas between the blocks define vertical and horizontal grooves 256 and 257 that are relatively flexible since they lack a three-dimensional shape. Thus, while the body 229 is able to create space between the cover 227 and the resilient members 224, the body 229 is also flexible and able to conform to any shape defined by the plurality of resilient members 224. By this arrangement, the body 229 provides a desired shape change as the lumbar device is vertically adjusted, yet the lumbar device 228 supplements and complements the lumbar support force already provided by the resilient members 224 in a lumbar region of the back support 221 without destroying the beneficial comfortable support provided by the resilient members 224.

The outboard ends of the body 229 (FIG. 29) include a bridge flange 258 having a passageway 259 under the flange 258. The flange 258 is supported by reinforcing ribs 260 at each end. Fabric loops 236 extend through the passageway 259 under the flange 258. The horizontal groove 257 includes sufficient space for receiving a linear mid-section of the wire 251, and further includes at least two pair of opposing bumps 261 forming a resilient detent for frictionally snappingly engaging the wire 251 to hold it in position in the horizontal groove 257. There is a space 262 between the flange 258 and the end of the hollow blocks formed by wall portions 253-254, and the wire 251 includes back-and-forth "L" bends 263 shaped to fit into the space flat against the body 229.

The handles 235 (FIG. 29) each include an L-shaped grip 264 having a flat portion 265, and a perpendicular outer flange 266 for slidably engaging a front and outer surface of the side frame members 241. A protrusion 267 extends from the flat portion 265 inboard of the outer flange 266. The protrusion 267 slidably engages a slot 268 (FIG. 28) in a front of the side frame member 241 for guiding and also limiting the vertical adjustment of the handles 235. A loop 270 (FIG. 29) is formed on an inboard end of the grip 264, and includes a hole 271 through which the fabric loop 236 is positioned. The handles 235 are attached to the ends of the body 229 by the stretchable fabric loops 236, permitting the handles 235 to track along non-parallel side frame portions of the perimeter frame 224 during lumbar adjustment.

Assembly of the lumbar device 228 (FIG. 29) is very straightforward. A strip of fabric is extended through a hole 271 on each handle 235 and sewn to form the fabric loops 236. The fabric loops 236 are extended through the passageways 259 under flanges 258 on each end of the body 229, and the "L" bends 263 of the wire 251 are passed through the fabric loops 236. The wire 251 is then snapped into the groove 257, where it is retained in place by the detent bump 261. The lumbar device 228 is then positioned between the cover 227 and the back frame 224, with the handles 235 being located on each side and with the protrusions 267 operably engaging the slots 268 in the side frame sections 241. The elastic fabric loops 236 are stretchable and are stretched when assembled, such that they tension the handles 235 against the side frame sections 241 to provide friction to hold the lumbar device 228 in a selected adjusted position.

Figure 35:
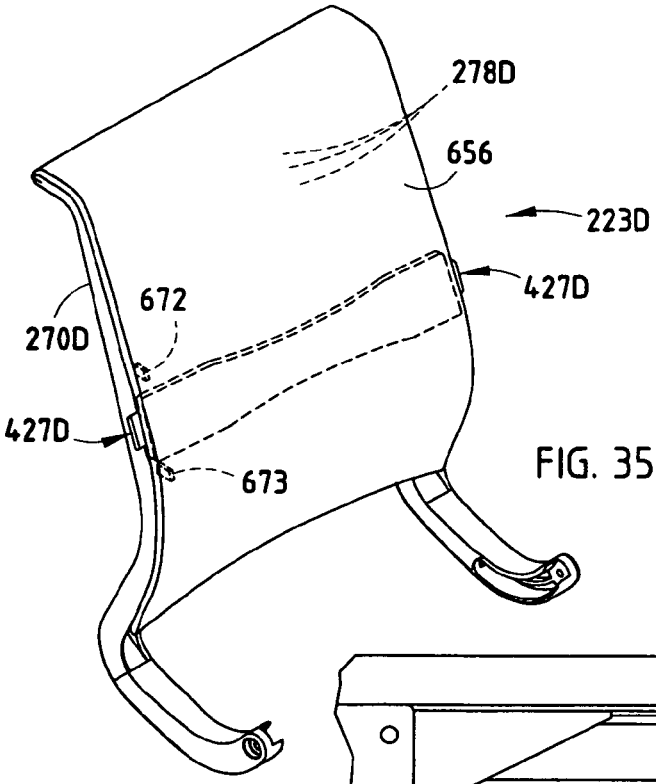
FIGS. 35 and 36 are perspective and rear views of the back of FIG. 27 but including a modified lumbar device.
Figure 36:
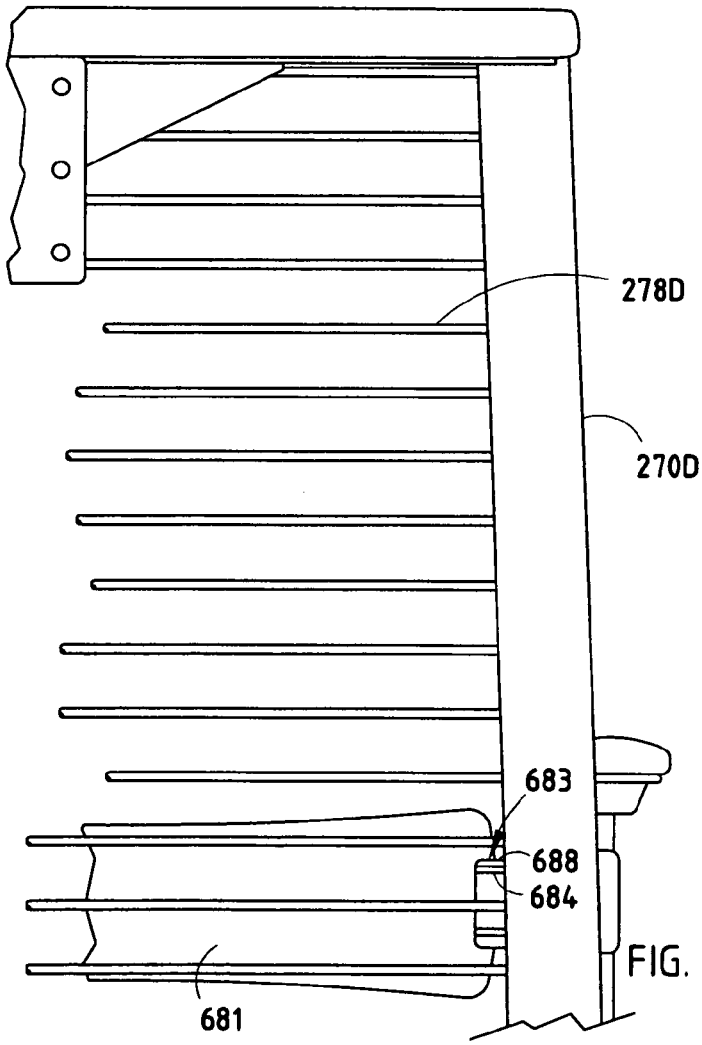
Figure 37:
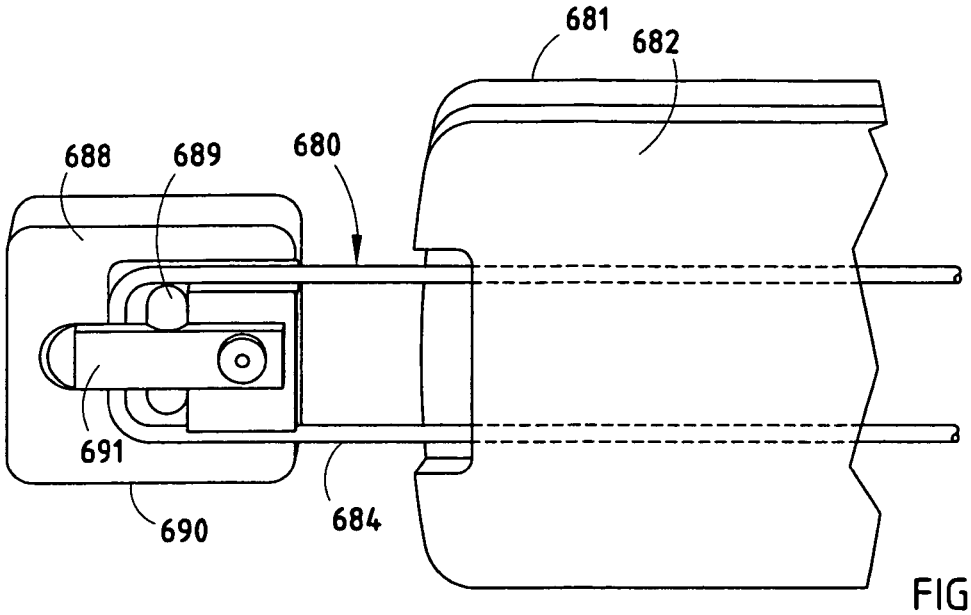
FIGS. 37-38 are an enlarged end section and an exploded perspective view of the lumbar device shown in FIGS. 35-36.
Figure 38:
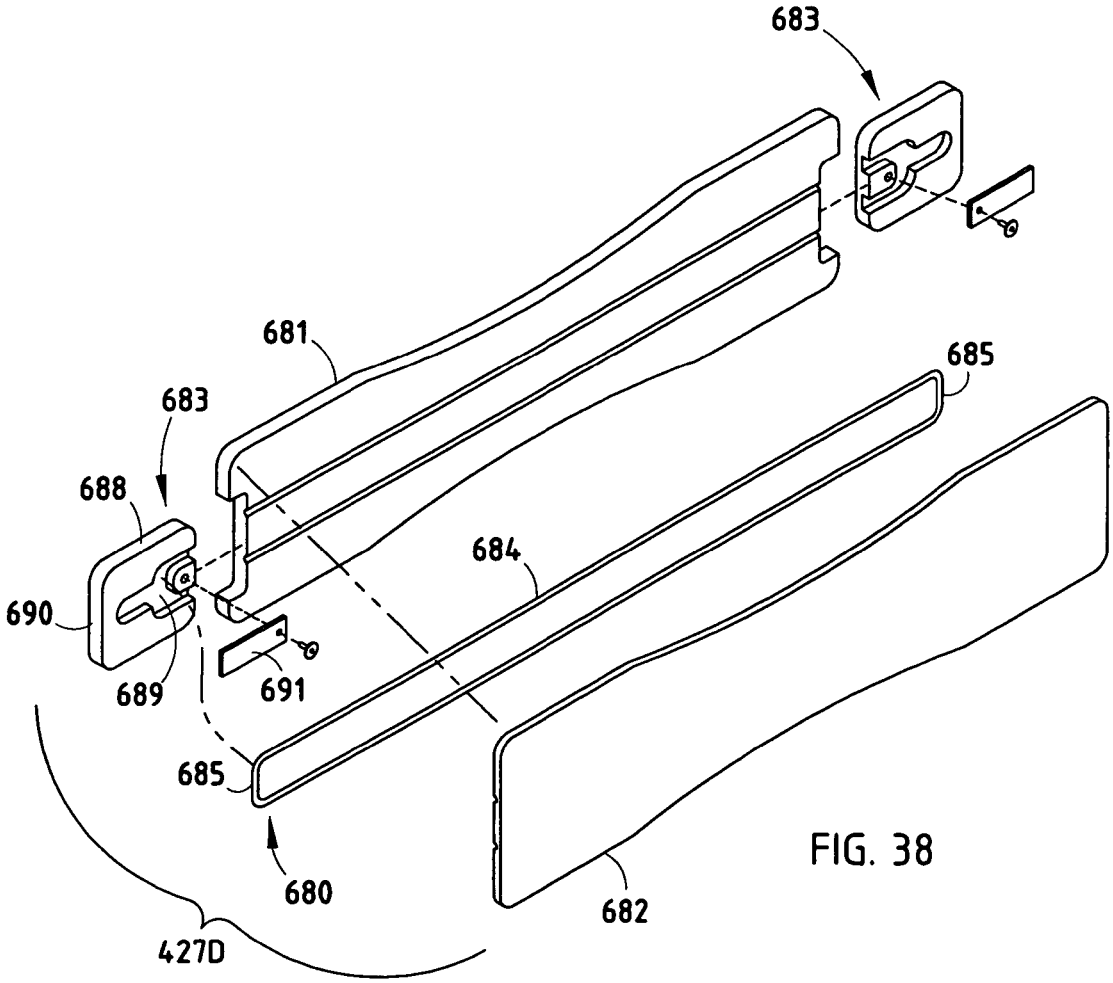

The lumbar device 427D (FIGS. 35-37) is positioned between the back covering 656 and the back frame 270D. The lumbar device 427D can be shifted vertically between the protrusions 672 and 673 for adjusting the lumbar support provided. The lumbar device 427D (FIG. 36) includes a wire 680, front and rear bow-tie-shaped thin panels 681 and 682, and opposing handles 683. The wire 680 is generally rectangular, and includes long resilient straight sections 684 and short ends 685. The thin panels 681 and 682 capture the wire 680 therebetween. It is contemplated that the thin panels 681 and 682 can be held together in different ways. For example, the two parts can be held together by separate fasteners (e.g., rivets, screws, mechanical interlocks, snaps), or can be held together by bonding techniques (e.g., heat staking, ultrasonic bonding, adhesive), or by other means known in the art. It is contemplated that the lumbar panels 681 and 682 can be extruded or molded. It is also contemplated that they can be made as a single part, with the panels 681 and 682 being held together with an integrally-molded living hinge and with a hook and tab feature opposite the living hinge for securement.

Unlike prior art lumbar devices, it is contemplated that the front and rear thin panels 681 and 682 are as thin as possible and are surprisingly flexible, so that the lumbar support comes from the active flexing of the wire 680, rather than from a stiff flat part. Thus, the lumbar support provided is very much like the support provided by the wires 278D in "comfort surface" of the back 223D. As a result, the lumbar support comes from the increase in force versus displacement curve provided (i.e., the wire 680 of the lumbar device supplements the wires 278D of the back 223D) . . . instead of the increased lumbar support coming only from a forced shape change in the lumbar area of the back 223D. Nonetheless, it is contemplated that increased lumbar support can come from both a lumbar shape change and also an increased lumbar support force curve.

The wire 680 is able to flex and move within and between the panels 681 and 682, and the ends 685 of the wire 680 extend outward from ends of the panels 681 and 682. Handles 683 include a thin body 688 with a U-shaped cavity 689 for receiving the ends 685. A handle 690 is attached to an end of components 680, 681, 682, and extends outward from them to form a grip to facilitate adjustment of the lumbar device 427D that can be grasped from a side of the chair 220D. The wire 680 can be snapped into position or a second tab or a clip 691 can be provided to loosely retain the wire 680 slidably within the U-shaped cavity 689. Advantageously, one or both sides of the lumbar device 427D can be adjusted, so that an optimal comfortable support can be obtained. The lumbar device 427D is held in place by the tension of the back covering 656, which, due to the curvature of the back, causes tension between the back covering 656 and the back frame 667.

It is contemplated that the wire loop 680 can be replaced with a flat strip of spring metal or leaf-spring-like plastic member. In fact, the entire lumbar wire 680 and "clam shell" covers 681, 682 could be replaced with a single molding or stamping, with its handles 242 being formed on or attached to ends of the lumbar device.

Figure 39:
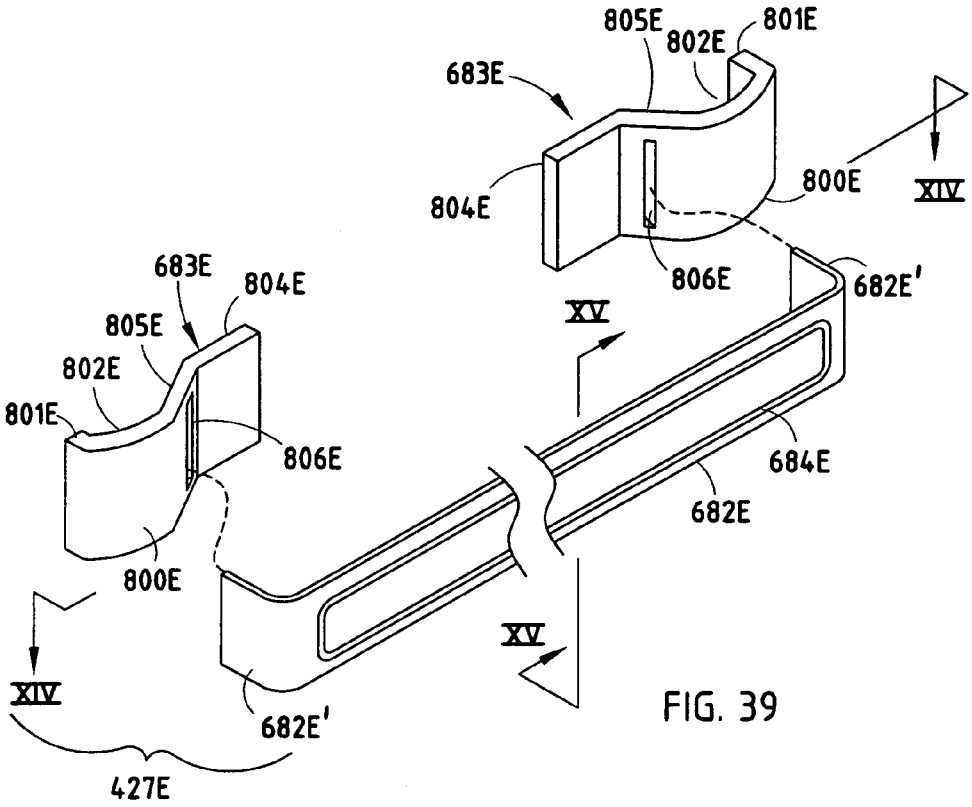
FIG. 39 is an exploded view of another modified lumbar device.
Figure 40:
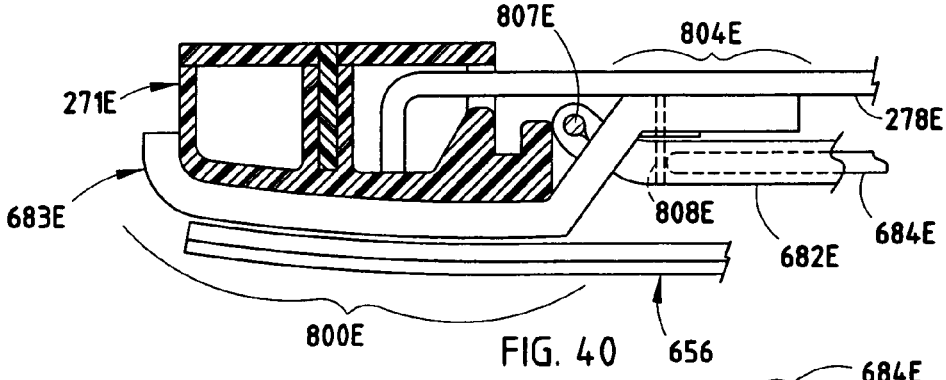
FIGS. 40-41 are cross sections taken along lines XIV-XIV and XV-XV in FIG. 39.
Figure 41:
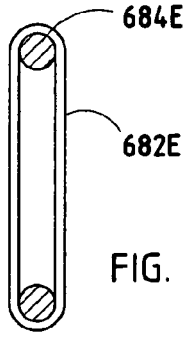

Another lumbar device 427E (FIGS. 39-41) includes a rectangular wire 684E positioned inside of a sock 682E of slightly-elastic material, such as slippery LYCRA® material. The sock material can be black, fabric-color, patterned, see-through, or translucent. Handles 683E are attached to ends 682E' of the sock 682E. The handles 683E include an outer end section 800E with a lip 801E forming a recess 802E that slidably engages a front surface of the back frame side sections 271E. The inboard end 804E is offset from an intermediate section 805E to form a shelf for supporting the end of the wire 684E that is co-planar with the outer end section 800E. An end 682E' of the sock 682E is fed through an aperture 806E in the intermediate section 805E. The end 682E' is doubled back and either looped around an anchor 807E or is secured (e.g., by stapling or fastener 808E) to the handle 683E.

The lumbar device 427E is positioned under the upholstery back covering and in front of the back frame side sections 271E, with the handles 683E slidably engaging the side section 271E. If the back frame side sections 271E are non-parallel, the sock 682E stretches (or elastically shrinks) to compensate as the lumbar device 427E is moved vertically. The slipperiness of the sock 682E helps the lumbar device 427E slip up and over each successive back wire 278E as the lumbar device 427E is vertically adjusted. The long parallel sections of the wire 684E can be (but do not necessarily need to be) bent to form a slightly bowtie-shaped arrangement, which shape also helps slip up and over each successive wire 278E.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A seating unit comprising:

a base with a control housing and a guide extending across the control housing;

a seat supported on the base;

a back supported on the base for reclining movement; and a back stop slidably mounted on the guide for selective translational movement to a plurality of different positions where the back stop limits recline of at least the back to a plurality of selectable recline positions corresponding to the plurality of different positions.

2. The seating unit defined in claim 1, including a cable connected to the back stop for sliding the back stop along the guide.

3. The seating unit defined in claim 1, wherein the guide includes at least one rod.

4. The seating unit defined in claim 3, wherein the at least one rod includes a pair of parallel rods.

5. The seating unit defined in claim 1, including a movable component associated with one of the back and seat, and wherein the back stop includes at least two abutment surfaces configured to selectively abut the movable component to thus limit recline of the seat and back.

6. The seating unit defined in claim 1, wherein the seat is operably supported on the back for synchronous movement upon recline of the back.

7. The seating unit defined in claim 1, including a link pivotally connected to the base and also pivotally connected to the seat at a different location, the back stop being configured to abut the link to limit movement of the seat and the back.

8. The seating unit defined in claim 1, wherein the base includes at least one flexible support with ends extending laterally of the control housing, the ends being configured to flexibly move in forward and rearward directions and supporting one of the seat and back.

9. The seating unit defined in claim 1, wherein the back includes a back frame with spaced-apart side frame members and having resilient support wires extending therebetween.

10. A seating unit comprising:

a base with a control housing;

a back supported on the base for reclining movement;

a seat connected by a pivoting link to the base for synchronous movement with the back upon recline of the back; and a back stop operably mounted on the control housing for selective movement to a plurality of different positions where the back stop engages the link to limit movement of the seat and hence limit recline of the back to a plurality of selectable recline positions corresponding to the plurality of different positions.

11. The seating unit defined in claim 10, including a cable connected to the back stop for sliding the back stop along the guide.

12. The seating unit defined in claim 10, including a guide mounted in the control housing for slidably supporting the back stop.

13. The seating unit defined in claim 12, wherein the guide includes at least one rod extending across the control housing at a location above a bottom of the control housing.

14. The seating unit defined in claim 10, wherein the back stop includes at least two abutment surfaces configured to selectively abut the link to thus limit recline of the seat and the back.

15. The seating unit defined in claim 10, wherein the link is pivotally connected to the base at one end and also pivotally connected to the seat at another end.

16. The seating unit defined in claim 10, wherein the base includes at least one flexible support with ends extending laterally of the control housing, the ends being configured to flexibly move in forward and rearward directions and supporting one of the seat and back.

17. A seating unit comprising:

a base with a control housing and at least one flexible support extending laterally on each side of the housing, the at least one flexible support including ends configured to flexibly move in forward and rearward directions;

a back and a seat supported on the base for synchronous movement upon recline of the back, at least one of the back and seat being supported by the ends of the at least one flexible support; and a back stop operably mounted on the control housing for selective movement to a plurality of different positions where the back stop limits movement of the seat and hence limits recline of the back to a plurality of selectable recline positions corresponding to the plurality of different positions.

18. The seating unit defined in claim 17, including a cable connected to the back stop for sliding the back stop along the guide.

19. The seating unit defined in claim 17, including a guide mounted in the control housing for slidably supporting the back stop.

20. The seating unit defined in claim 19, wherein the guide includes at least one rod extending across the control housing at a location above a bottom of the control housing.

21. The seating unit defined in claim 17, including a link pivoted at one end to the base and to another end to the seat, and wherein the back stop engages the link to limit movement of the seat and hence the back.

22. In a seating unit having a control housing and a back supported on the control housing for reclining movement along a first direction, an improvement comprising:

at least one laterally-extending guide supported between first and second side walls of the control housing and a back stop slidably mounted on the guide for lateral translational movement between different back stopping; and a cable connected to the back stop for sliding the back stop along the guide.

23. The seating unit defined in claim 22, wherein the guide includes at least one rod.

24. The seating unit defined in claim 23, wherein the at least one rod includes a pair of parallel rods.

25. The seating unit defined in claim 22, including a seat and a movable link associated with one of the back and the seat, the link moving during recline of the back, and wherein the back stop includes at least two abutment surfaces configured to selectively abut the movable link to thus limit recline of the seat and back.

26. The seating unit defined in claim 25, wherein the seat is operably supported on the back for synchronous movement upon recline of the back.

* * * * *